US011311087B2

(12) United States Patent
Del Moral et al.

(10) Patent No.: US 11,311,087 B2
(45) Date of Patent: Apr. 26, 2022

(54) WALLET FOR MOBILE ELECTRONIC DEVICE OR MOBILE ELECTRONIC DEVICE CASE

(71) Applicant: Speculative Product Design, LLC, San Mateo, CA (US)

(72) Inventors: Darrick Del Moral, San Bruno, CA (US); Bryan Lee Hynecek, Redwood City, CA (US); Eric Lo, Oakland, CA (US); Patrick Christian, Petaluma, CA (US); Christopher William Ledesma, Arcadia, CA (US)

(73) Assignee: Speculative Product Design, LLC, San Mateo, CA (US)

( * ) Notice: Subject to any disclaimer, the term of this patent is extended or adjusted under 35 U.S.C. 154(b) by 269 days.

(21) Appl. No.: 16/452,085

(22) Filed: Jun. 25, 2019

(65) Prior Publication Data

US 2020/0214411 A1 Jul. 9, 2020

Related U.S. Application Data

(63) Continuation-in-part of application No. 16/241,363, filed on Jan. 7, 2019, now abandoned.

(51) Int. Cl.
*A45C 1/06* (2006.01)
*A45C 11/32* (2006.01)
(Continued)

(52) U.S. Cl.
CPC ..... *A45C 11/321* (2013.01); *A45C 1/06* (2013.01); *A45C 11/182* (2013.01);
(Continued)

(58) Field of Classification Search
CPC ..... A45C 11/321; A45C 11/182; A45C 2011/002; A45C 2001/065; A45C 2001/067; A45C 1/06
(Continued)

(56) References Cited

U.S. PATENT DOCUMENTS 4,071,065 A 1/1978 Halbich
4,768,648 A 9/1988 Glass
(Continued)

FOREIGN PATENT DOCUMENTS

CN 1402497 A 3/2003
CN 200944922 Y 9/2007
(Continued)

OTHER PUBLICATIONS

Chinese Search Report for Application No. 202010013862.3, dated May 7, 2021, 7 pages.
(Continued)

*Primary Examiner* — Sue A Weaver
(74) *Attorney, Agent, or Firm* — Lerner, David, Littenberg, Krumholz & Mentlik, LLP

(57) ABSTRACT

A wallet kit for a mobile electronic device or a mobile electronic device case. The wallet kit includes a wallet with a housing defined by walls of the housing. A wallet pocket configured to hold a card is formed by the walls. A wallet opening is formed in one of the walls and is configured to accept insertion of the card into the wallet pocket. An elastomeric bumper is arranged inside the wallet pocket.

21 Claims, 29 Drawing Sheets

(51) Int. Cl.
*A45C 11/18* (2006.01)
*A45C 11/00* (2006.01)

(52) U.S. Cl.
CPC .. *A45C 2001/065* (2013.01); *A45C 2001/067* (2013.01); *A45C 2011/002* (2013.01)

(58) Field of Classification Search
USPC ..... 206/320; 150/147
See application file for complete search history.

(56) References Cited

U.S. PATENT DOCUMENTS

| | | | |
|---|---|---|---|
| 5,080,223 | A | 1/1992 | Mitsuyama |
| 5,360,108 | A | 11/1994 | Alagia |
| 5,445,199 | A | 8/1995 | Jia |
| 5,718,329 | A | 2/1998 | Ippolito et al. |
| 5,933,328 | A | 8/1999 | Wallace et al. |
| 6,026,873 | A | 2/2000 | Van Geer |
| 6,068,119 | A | 5/2000 | Derr et al. |
| 6,164,442 | A | 12/2000 | Stravitz |
| 6,341,693 | B2 | 1/2002 | Konno et al. |
| 6,427,837 | B1 | 8/2002 | Shields |
| 6,533,118 | B1 | 3/2003 | Nelson |
| 6,616,111 | B1 | 9/2003 | White |
| 6,634,494 | B1 | 10/2003 | Derr et al. |
| 7,093,717 | B2 | 8/2006 | Sakai et al. |
| 7,204,398 | B1 | 4/2007 | Smith, Sr. |
| D565,840 | S | 4/2008 | Kwak |
| D567,500 | S | 4/2008 | Kwak et al. |
| D574,819 | S | 8/2008 | Andre et al. |
| D602,689 | S | 10/2009 | Hewitt |
| 7,641,046 | B2 | 1/2010 | Tsang et al. |
| D615,078 | S | 5/2010 | Bradley |
| D619,130 | S | 7/2010 | Fellig |
| D619,356 | S | 7/2010 | Hillman |
| D624,064 | S | 9/2010 | Esposito |
| D626,119 | S | 10/2010 | Fellig |
| D631,246 | S | 1/2011 | Boettner |
| 8,047,364 | B2 | 11/2011 | Longinotti-Buitoni |
| D653,656 | S | 2/2012 | Charnas et al. |
| D665,994 | S | 8/2012 | Bamke |
| 8,251,210 | B2 | 8/2012 | Schmidt et al. |
| 8,267,251 | B2 | 9/2012 | Mongan et al. |
| 8,418,852 | B2 | 4/2013 | Ziemba |
| 8,504,127 | B2 | 8/2013 | Altschul et al. |
| 8,596,449 | B2 | 12/2013 | Mongan et al. |
| 8,726,952 | B2 | 5/2014 | Jambunathan et al. |
| D706,255 | S | 6/2014 | Akana et al. |
| 8,757,376 | B2 | 6/2014 | Azzoni |
| 8,770,402 | B2 | 7/2014 | Bergreen et al. |
| D712,890 | S | 9/2014 | McCormac et al. |
| 8,833,379 | B1 | 9/2014 | Kaplan |
| 8,863,793 | B2 | 10/2014 | Black |
| 8,869,977 | B2 | 10/2014 | Nlkosey |
| D720,735 | S | 1/2015 | Turocy |
| D721,360 | S | 1/2015 | Laffon de Mazieres et al. |
| D724,573 | S | 3/2015 | Stevinson |
| 8,978,886 | B2 | 3/2015 | Ziemba |
| D726,171 | S | 4/2015 | Edwards |
| 9,027,746 | B2 | 5/2015 | Smith |
| 9,060,580 | B2 | 6/2015 | Tages |
| D740,798 | S | 10/2015 | Poon et al. |
| D747,707 | S | 1/2016 | Roberts et al. |
| D747,708 | S | 1/2016 | Roberts et al. |
| D753,641 | S | 4/2016 | Roberts et al. |
| D754,651 | S | 4/2016 | Roberts et al. |
| D754,652 | S | 4/2016 | Roberts et al. |
| D756,344 | S | 5/2016 | Roberts et al. |
| D757,702 | S | 5/2016 | Kanazawa |
| D757,703 | S | 5/2016 | Kanazawa |
| D757,704 | S | 5/2016 | Roberts et al. |
| D759,004 | S | 6/2016 | Stevinson |
| D760,210 | S | 6/2016 | Mao et al. |
| D760,496 | S | 7/2016 | Schioll |
| 9,413,412 | B2 | 8/2016 | Gipson |
| D771,612 | S | 11/2016 | Roberts et al. |
| D772,854 | S | 11/2016 | Igarashi |
| D775,615 | S | 1/2017 | Tien |
| D776,100 | S | 1/2017 | Igarashi |
| D776,645 | S | 1/2017 | Del Moral et al. |
| D777,715 | S | 1/2017 | Sawaya |
| D778,271 | S | 2/2017 | Stump et al. |
| 9,615,476 | B2 | 4/2017 | Rayner et al. |
| 9,642,427 | B2 | 5/2017 | Ziemba |
| D789,344 | S | 6/2017 | Kim |
| 9,872,546 | B2 | 1/2018 | Kim |
| 9,907,375 | B1 | 3/2018 | Kitchen |
| D814,453 | S | 4/2018 | Chiang et al. |
| 10,027,783 | B2 | 7/2018 | Dukerschein et al. |
| D864,936 | S | 10/2019 | Chiang et al. |
| 10,441,044 | B2 | 10/2019 | Chiang et al. |
| 2003/0057112 | A1 | 3/2003 | Keough |
| 2003/0057277 | A1 | 3/2003 | Kimura et al. |
| 2003/0230514 | A1 | 12/2003 | Baker |
| 2005/0139498 | A1 | 6/2005 | Goros |
| 2005/0241972 | A1 | 11/2005 | Hassett |
| 2007/0057004 | A1 | 3/2007 | Butler et al. |
| 2007/0215663 | A1 | 9/2007 | Chongson et al. |
| 2007/0254129 | A1 | 11/2007 | Horblitt |
| 2007/0262112 | A1 | 11/2007 | Butler et al. |
| 2008/0121321 | A1 | 5/2008 | Tiner et al. |
| 2008/0121322 | A1 | 5/2008 | Thomson |
| 2008/0142129 | A1 | 6/2008 | Reasner et al. |
| 2008/0169351 | A1 | 7/2008 | Whiting |
| 2009/0032421 | A1 | 2/2009 | Sween et al. |
| 2010/0096284 | A1 | 4/2010 | Bau |
| 2010/0116702 | A1 | 5/2010 | Schentrup et al. |
| 2010/0122756 | A1 | 5/2010 | Longinotti-Buitoni |
| 2010/0147737 | A1 | 6/2010 | Richardson et al. |
| 2010/0224519 | A1 | 9/2010 | Kao |
| 2010/0230201 | A1 | 9/2010 | McVicar |
| 2010/0230301 | A1 | 9/2010 | Fellig |
| 2011/0259771 | A1 | 10/2011 | Johnson |
| 2011/0277892 | A1 | 11/2011 | Black |
| 2011/0294556 | A1 | 12/2011 | Carlberg et al. |
| 2012/0037524 | A1 | 2/2012 | Lonsdale et al. |
| 2012/0067751 | A1 | 3/2012 | Mongan et al. |
| 2013/0037187 | A1 | 2/2013 | D'Amore et al. |
| 2013/0061990 | A1 | 3/2013 | Syma |
| 2014/0076747 | A1 | 3/2014 | Mongan et al. |
| 2014/0191003 | A1 | 7/2014 | Cox |
| 2014/0251368 | A1* | 9/2014 | Lawson ..... A45C 13/02 132/287 |
| 2014/0262853 | A1 | 9/2014 | DeChant |
| 2015/0059937 | A1* | 3/2015 | Singer ..... A45C 11/32 150/147 |
| 2015/0119118 | A1 | 4/2015 | Ashley et al. |
| 2015/0195929 | A1 | 7/2015 | Roberts et al. |
| 2016/0206065 | A1 | 7/2016 | Ehrlich |
| 2017/0187853 | A1 | 6/2017 | Dukerschein et al. |
| 2017/0188676 | A1 | 7/2017 | Denike et al. |
| 2017/0196331 | A1 | 7/2017 | Gluck |
| 2017/0354229 | A1 | 12/2017 | Berkley et al. |
| 2020/0214410 | A1 | 7/2020 | Del Moral et al. |

FOREIGN PATENT DOCUMENTS

| | | | |
|---|---|---|---|
| CN | 201178768 | Y | 1/2009 |
| CN | 201571638 | U | 9/2010 |
| CN | 104883923 | A | 9/2015 |
| CN | 207504952 | U | 6/2018 |
| FR | 2709475 | A3 | 3/1995 |
| JP | H09266809 | A | 10/1997 |
| JP | 2004159683 | A | 6/2004 |
| JP | 3159716 | U | 6/2010 |
| KR | 200446444 | Y1 | 10/2009 |
| KR | 100934120 | B1 | 12/2009 |
| KR | 20100011646 | U | 12/2010 |
| KR | 101054575 | B1 | 8/2011 |
| KR | 200458135 | Y1 | 1/2012 |
| KR | 20120067260 | A | 6/2012 |
| KR | 200470099 | Y1 | 12/2013 |
| KR | 101929202 | B1 | 12/2018 |
| WO | 2006097780 | A1 | 9/2006 |

(56) References Cited

FOREIGN PATENT DOCUMENTS

| | | | |
|---|---|---|---|
| WO | 2007035438 | A2 | 3/2007 |
| WO | 2012149304 | A1 | 11/2012 |
| WO | 2018092996 | A1 | 5/2018 |

OTHER PUBLICATIONS

Extended European Search Report with Written Opinion for Application No. 20150194.7 dated May 12, 2020, 7 pages.
Del Moral et al., U.S. Appl. No. 16/241,363, filed Jan. 7, 2019, titled "Wallet for Mobile Electronic Device or Mobile Electronic Device Case".
Del Moral et al., U.S. Appl. No. 29/675,949, filed Jan. 7, 2019, titled "Wallet for Mobile Device or Mobile Device Case".
Del Moral et al., U.S. Appl. No. 29/696,081, filed Jun. 25, 2019, titled "Wallet for Mobil Device or Mobile Device Case".
Chinese Office Action including Seach Report for Application No. 2011800453951 dated Aug. 5, 2014, 5 pages.
Chinese Search Report for Application No. 2011800453951 dated Aug. 19, 2015, 1 page.
Chinese Search Report for Application No. 201610137326.8 dated Jun. 10, 2019, pp. 1-2.
Extended European Search Report for Application No. 11827427.3 dated Dec. 4, 2017, 8 pages.
Extended European Search Report for Application No. 13834548.3 dated Apr. 8, 2016, 7 pages.
http://www.case-mate.com/iPhone-3G-Cases/Case-Mate-iPhone-3G-3GS-ID-Credi- t-Card-Cases.asp, downloaded from the internet on Apr. 23, 2012, 3 pages.
http://www.case-mate.com/products/black-iphone-6-6s-wallet-folio-case, downloaded from the internet on Feb. 8, 2017, 14 pages.
http://www.otterbox.com/en-us/commuter-series-wallet, downloaded from the internet on Feb. 16, 2017, 8 pages.
http://www.otterbox.com/en-us/strada-series, downloaded from the internet on Feb. 8, 2017, 7 pages.
http://www.spigen.com/products/iphone-6-case-wallet-s-4-7?variant= 5905351489, downloaded from the internet on Feb. 8, 2017, 12 pages.
https://www.incipio.com/cases/iphone-cases/iphone-7-cases/iphone-7-stashback-case.html, downloaded from the internet on Feb. 8, 2017, 8 pages.
https://www.incipio.com/cases/iphone-cases/iphone-7-cases/iphone-7-stowaway-case.html, downloaded from the internet on Feb. 8, 2017, 5 pages.
International Search Report and Written Opinion dated May 1, 2012 in related International Application No. PCT/US2011/052519 filed Sep. 21, 2011, 9 pages.
International Search Report for Application No. PCT/US2013/057995 dated Dec. 4, 2013, 3 pages.
Incipio DualPro Case, posted at amazon.com, posting date not given, [online], [site visited Jul. 20, 2017]. Available from Internet,<URL: https://www.amazon.com/iPhoneIncipioDualProShockAbsorbing/dp/B01JPIBZUO>.
Lohasic 3-In-1 Case, posted at amazon.com, posting date not given, [online], [site visited Jul. 20, 2017]. Available from Internet, <URL: https://www.amazon.com/RoybensAntiScratchAntifingerprintShockproofElectroplate/dp/B01LMW06DG>.
OtterBox Symmetry Case, posted at amazon.com, posting date not given, [online], [site visited Jul. 20, 2017]. Available from Internet, <URL: https://www.amazon.com/OtterBoxSYMMETRYCaseiPhoneONLY/dp/B01K6PB3XG/>.
Speck iPhone 7 Plus Presidio, posted at amazon.com, posting date Aug. 8, 2016, [online], [site visited Jul. 20, 2017]. Available from Internet, <URL: https://www.amazon.com/SpeckProducts-PresidioPhoneiPhone/dp/B01 JRU57Y2>.
Yang et al., U.S. Appl. No. 29/706,324, filed Sep. 19, 2019, titled "Case for an Electronic Device".
Del Moral et al., U.S. Appl. No. 29/675,949, filed Jan. 7, 2019, "Wallet for Mobile Device or Mobile Device Case."
Del Moral et al., U.S. Appl. No. 29/696,081, filed Jun. 25, 2019, "Wallet for Mobile Device or Mobile Device Case."
European Union Intellectual Property Office Community Design Registration No. 004034544-0001, filed and registered on Jun. 6, 2017, entitled "Presidio Wallet", and published on Aug. 17, 2017.
European Union Intellectual Property Office Community Design Registration No. 004034544-0002, filed and registered on Jun. 6, 2019, entitled "Presidio Wallet", and published on Aug. 17, 2017.
European Union Intellectual Property Office Community Design Registration No. 006612875-0005, filed and registered on Jul. 4, 2019, entitled "Wallet for Mobile Device or Mobile Device Case", published on Jul. 29, 2019.
European Union Intellectual Property Office Community Design Registration No. 006612875-0006, filed and registered on Jul. 4, 2019, entitled "Wallet for Mobile Device or Mobile Device Case", and published on Jul. 29, 2019.
European Union Intellectual Property Office Community Design Registration No. 006612875-0007, filed and registered on Jul. 4, 2019, entitled "Wallet for Mobile Device or Mobile Device Case", and published on Jul. 29, 2019.
European Union Intellectual Property Office Community Design Registration No. 006612875-0008, filed and registered on Jul. 4, 2019, entitled "Wallet for Mobile Device or Mobile Device Case", and published on Jul. 29, 2019.
European Union Intellectual Property Office Community Design Registration No. 006612875-0001, filed and registered on Jul. 4, 2019, entitled "Wallet for Mobile Device or Mobile Device Case", and published on Jul. 29, 2019.
European Union Intellectual Property Office Community Design Registration No. 006612875-0002, filed and registered on Jul. 4, 2019, entitled "Wallet for Mobile Device or Mobile Device Case", and published on Jul. 29, 2019.
European Union Intellectual Property Office Community Design Registration No. 006612875-0003, filed and registered on Jul. 4, 2019, entitled "Wallet for Mobile Device or Mobile Device Case", and published on Jul. 29, 2019.
European Union Intellectual Property Office Community Design Registration No. 006612875-0004, filed and registered on Jul. 4, 2019, entitled "Wallet for Mobile Device or Mobile Device Case", and published on Jul. 29, 2019.
Search Report from First Office Action for Chinese Application No. 202010013862.3 dated May 7, 2021; 3 pages.

* cited by examiner

WALLET FOR MOBILE ELECTRONIC DEVICE OR MOBILE ELECTRONIC DEVICE CASE

CROSS-REFERENCE TO RELATED APPLICATION

The present application is a continuation-in-part of U.S. patent application Ser. No. 16/241,363 filed Jan. 7, 2019, the disclosure of which is hereby incorporated herein by reference.

FIELD OF THE INVENTION

The present invention relates to a wallet for a mobile electronic device or a mobile electronic device case. The wallet has a pocket or pouch configured to hold cards, such as credit cards, debit cards, personal ID cards, driver licenses, and the like. An axle connected with an elastomeric bumper is arranged inside the pocket or pouch. The elastomeric bumper applies a force to an edge of a card arranged in the pocket or pouch so as to securely hold the card in the pocket or pouch.

The wallet may be part of a wallet kit that includes a holder that is configured to be attached to the back of the case or mobile electronic device. The holder is also configured and sized to removably hold the wallet so that the wallet can be easily attached to and removed from the case or mobile electronic device via the holder.

Wallets for cases and mobile electronic devices have typically been designed either as part of the case (i.e., irremovable therefrom) or as a separate device that attaches to the back of a case or mobile electronic device via adhesive. Both of these designs present problems. For example, wallets that are part of the case can make the case too thick to allow for wireless electric charging (e.g., inductive charging) of the electronic device while it is in the case. This requires a user to remove the electronic device from the case in order to wirelessly charge the electronic device. Adhesive wallets that attach to the back of a case can also make the case too thick for wireless charging. And if such a separate adhesive wallet is attached directly to the back of the electronic device itself, then wireless charging can become completely impossible without removing the adhesive wallet, thereby destroying the adhesive and making the wallet useless for its intended purpose.

SUMMARY OF THE INVENTION

As such, it is desirable to provide a new wallet for a mobile electronic device or mobile electronic device case that can be removably attached to the back of the case of electronic device without adhesive. This assists in wireless electrical charging. It also makes it easy to temporarily separate the wallet from the case or electronic device so that the wallet can be slipped into a pocket or bag separately for ease of transportation or for being carried into an environment where electrical devices are not permitted.

Another advantage of the invention is the ability to attach the wallet to the case or electronic device in multiple configurations or orientations, so that in at least one configuration or orientation the items in the wallet are not accessible and cannot easily slip out or be removed.

It is also desirable to provide a new wallet that has a mechanism for securely retaining cards in the wallet without significantly increasing the thickness of the wallet. This may be achieved by incorporating an elastomeric bumper—for example as described below—into the inside of the wallet. The elastomeric bumper may hold cards inside the wallet by applying a force via an applied pressure in a length or width direction to an edge of the cards rather than in a thickness direction to one of the two faces of the cards. By incorporating a device that applies pressure in a length or width direction as opposed to a thickness direction, the thickness of the wallet may be reduced, possibly enabling wireless electrical charging even if the wallet is attached to the case or electronic device. That being said, an elastomeric bumper extending along a length such that the insert applies a force in the thickness direction to one of the two faces of the cards is encompassed by the scope of the present disclosure.

According to the present invention there is therefore provided a case for a mobile device as described by way of example below and in the accompanying claims.

In one embodiment of the invention there is provided a wallet kit (1, 101, 201) for a mobile electronic device or a mobile electronic device case. The wallet kit may include a wallet (2, 102, 202) with a housing (4, 104) that may have a front wallet wall (5, 105), a rear wallet wall (6, 106), an upper wallet wall (7, 107), a lower wallet wall (8, 108), a first wallet side wall (9), and a second wallet side wall (10). The rear wallet wall may be opposite to the front wallet wall. The upper wallet wall may connect an upper end of the rear wallet wall to an upper end of the front wallet wall. The lower wallet wall may be opposite to the upper wallet wall and may connect a lower end of the rear wallet wall to a lower end of the front wallet wall. The first wallet side wall may be between the upper wallet wall and the lower wallet wall and may connect a first side end of the rear wallet wall to a first side end of the front wallet wall. The second wallet side wall may be between the upper wallet wall and the lower wallet wall and may connect a second side end of the rear wallet wall to a second side end of the front wallet wall. A wallet pocket (11, 111) may be configured to hold a card. The wallet pocket may be formed by the front wallet wall, the rear wallet wall, the upper wallet wall, the lower wallet wall, and the second wallet side wall. A first wallet opening (12, 112) may be formed in the first wallet side wall and may be configured to accept insertion of the card into the wallet pocket. An elastomeric bumper (13, 113, 213) may be arranged inside the wallet pocket.

In another embodiment, the wallet kit further may include an axle (14, 114) around which the elastomeric bumper may be arranged.

In a further embodiment, the bumper may be in the form of a wheel (13, 113), while in another further embodiment, the bumper may be in the form of an elongated shaft or wedge (213) in which a longitudinal axis defined by the shaft or wedge extends in directions parallel to a direction of insertion of a card or cards (215) into the wallet pocket.

In yet another embodiment, the housing further may have an axle opening (27) that may be configured to accept insertion of the axle (14) with the elastomeric bumper (13) there-around into the wallet pocket.

In another embodiment, the front wallet wall (105) may cover the axle (114, 214) and the elastomeric bumper (113, 213) such that the axle and the elastomeric bumper may be unexposed when the front wallet wall is arranged facing away from the one of the mobile electronic device or the mobile electronic device case.

In a further embodiment, in which the housing further may have a second wallet opening (15) formed in the front wall (5, 105) which allows access to a card when arranged in the wallet pocket (11, 111). The second opening (15) may be different from the first wallet opening.

In yet a further embodiment, the first wallet opening may be formed in the front wall so that the front wallet wall has a shape in the form of an hourglass as a result of the first and the second wallet openings.

In another embodiment, the housing may include at least one material selected from the group consisting of hardened plastic materials, rigid or semi-rigid plastic materials, rigid rubber materials, polycarbonate materials, para-aramid materials, wood, and combinations thereof.

In yet another embodiment, the wallet kit (1, 101, 201) further may include a holder (3, 103) that may have a front side (16) that may be configured to attach to the wallet (2, 102, 202) and a rear side (17) opposite to the front side that may be configured to attach to a rear of the mobile electronic device or a mobile electronic device case.

In a further embodiment, the holder further may have a holder pocket (22, 122) that may be configured to accept the wallet.

In yet a further embodiment, the holder (3) further may have an attachment mechanism (23, 123, 24, 124) that may be configured to securely attach the wallet to the holder.

In another embodiment, the housing of the wallet may have a first attachment recess or opening (28, 128). The attachment mechanism may include a first protrusion (23, 123, 24, 124) that may be configured to fit into and to be accepted by the first attachment recess or opening when the wallet is arranged in the holder pocket with the rear wallet wall located between the holder and the front wallet wall.

In yet another embodiment, the housing of the wallet may have a second attachment recess or opening (29, 129). The attachment mechanism further may include a second protrusion that may be configured to fit into and to be accepted by the second attachment recess or opening when the wallet is arranged in the holder pocket with the rear wallet wall located between the holder and the front wallet wall.

In a further embodiment, the housing of the wallet may have a third attachment recess or opening (30, 130). The attachment mechanism may include a first protrusion that may be configured to fit into and to be accepted by the third attachment recess or opening when the wallet is arranged in the holder pocket with the front wallet wall located between the holder and the rear wallet wall.

In yet a further embodiment, the housing of the wallet may have a fourth attachment recess or opening (31, 131). The attachment mechanism further may include a second protrusion that may be configured to fit into and to be accepted by the fourth attachment recess or opening when the wallet is arranged in the holder pocket with the front wallet wall located between the holder and the rear wallet wall.

In another embodiment, the holder further may have a rear holder wall (32), an upper holder wall (18) that extends from an upper end of the rear holder wall (32), a lower holder wall (19) that is opposite to the upper holder wall and which extends from a lower end of the rear holder wall, a first holder side wall (20) that is between the upper holder wall and the lower holder wall and which extends from the rear holder wall, and a second holder side wall (21) that is between the upper holder wall and the lower holder wall and which extends from the rear holder wall. The holder pocket may be formed by the rear holder wall, the upper holder wall, the lower holder wall, the first holder side wall, and the second holder side wall.

In yet another embodiment, the first protrusion may extend from the upper end of the rear holder wall. The first protrusion may be separate from the upper holder wall and may be arranged between a first part (18*a*) of the upper holder wall (18) and a second part (18*b*) of the upper holder wall (18).

In a further embodiment, the first protrusion may extend from the lower holder wall. The first protrusion may be part of the lower holder wall.

In yet a further embodiment, a first holder opening (25) may be formed in the first holder side wall. The first holder opening may correspond to and may align with the first wallet opening or the second wallet opening when the wallet is arranged in the holder pocket.

In another embodiment, a second holder opening (26) may be formed in the second holder side wall. The second holder opening may correspond to and may be aligned with the first wallet opening or the second wallet opening when the wallet is arranged in the holder pocket.

In yet another embodiment, there is provided a wallet kit (1, 101, 201) for a mobile electronic device or a mobile electronic device case. The wallet kit may include a wallet (2, 102, 202) and a holder (3, 103). The wallet may include a housing (4, 104) that may have a front wallet wall (5, 105), a rear wallet wall (6, 106), an upper wallet wall (7, 107), a lower wallet wall (8, 108), a first wallet side wall (9), and a second wallet side wall (10). The rear wallet wall may be opposite to the front wallet wall. The upper wallet wall may connect an upper end of the rear wallet wall to an upper end of the front wallet wall. The lower wallet wall may be opposite to the upper wallet wall and may connect a lower end of the rear wallet wall to a lower end of the front wallet wall. The first wallet side wall (9) may be between the upper wallet wall and the lower wallet wall and may connect a first side end of the rear wallet wall to a first side end of the front wallet wall. The second wallet side wall may be between the upper wallet wall and the lower wallet wall and may connect a second side end of the rear wallet wall to a second side end of the front wallet wall. A wallet pocket (11, 111) may be configured to hold a card (215). The wallet pocket may be formed by the front wallet wall, the rear wallet wall, the upper wallet wall, the lower wallet wall, and the second wallet side wall. A first wallet opening (12, 112) may be formed in the first wallet side wall and may be configured to accept insertion of the card into the wallet pocket. The holder may have a front side (16) that may be configured to be removably attached to the wallet and a rear side (17) opposite to the front side (16) that may be configured to attach to a rear of the mobile electronic device or the mobile electronic device case.

In a further embodiment, the housing of the wallet may have a first attachment recess or opening (28, 128). The holder further may have an attachment mechanism (23, 123, 24, 124) that may be configured to securely attach the wallet to the holder. The attachment mechanism may include a first protrusion (23, 123, 24, 124) that may be configured to fit into and to be accepted by the first attachment recess or opening when the wallet is arranged in a holder pocket (22) defined by the holder with the rear wallet wall located between the holder and the front wallet wall.

In yet another embodiment, the holder may include an attachment mechanism to be attached to, such as by being clipped into, a rear of the mobile electronic device or the mobile electronic device case.

It is noted that the features of the above-described embodiments are not exclusive to each other, and that any one of the above embodiments/features can be combined with one or more of the other embodiments/features to arrive at further embodiments.

The inventive case can be designed to fit a variety of mobile devices—such as smartphones and other portable electronic devices.

BRIEF DESCRIPTION OF THE DRAWINGS

A more complete appreciation of the subject matter of the present invention and various advantages thereof may be realized by reference to the following detailed description and the accompanying drawings, in which.

DETAILED DESCRIPTION OF EMBODIMENTS

Figure 1:
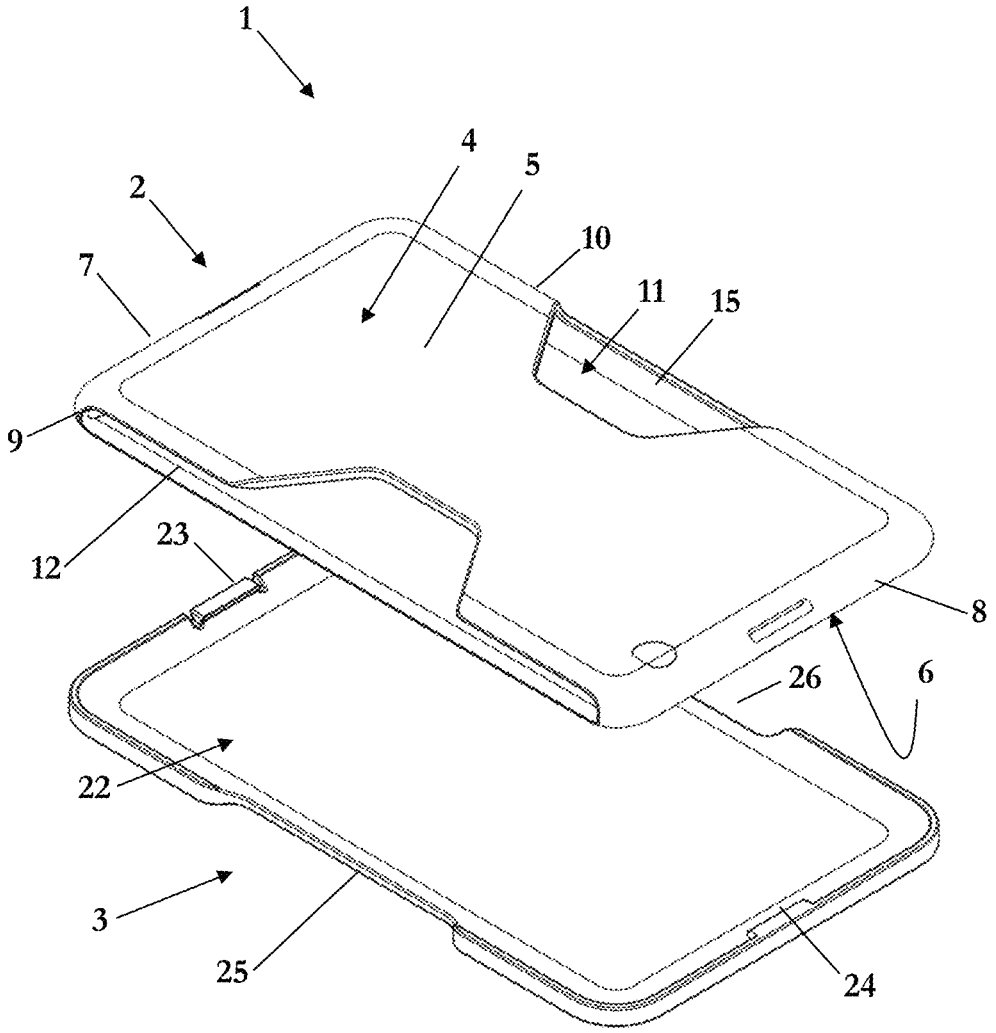
FIG. 1 is an exploded perspective view of a wallet kit in accordance with an embodiment of the invention, shown in a state with a wallet of the kit detached from a holder of the kit.
Figure 2:
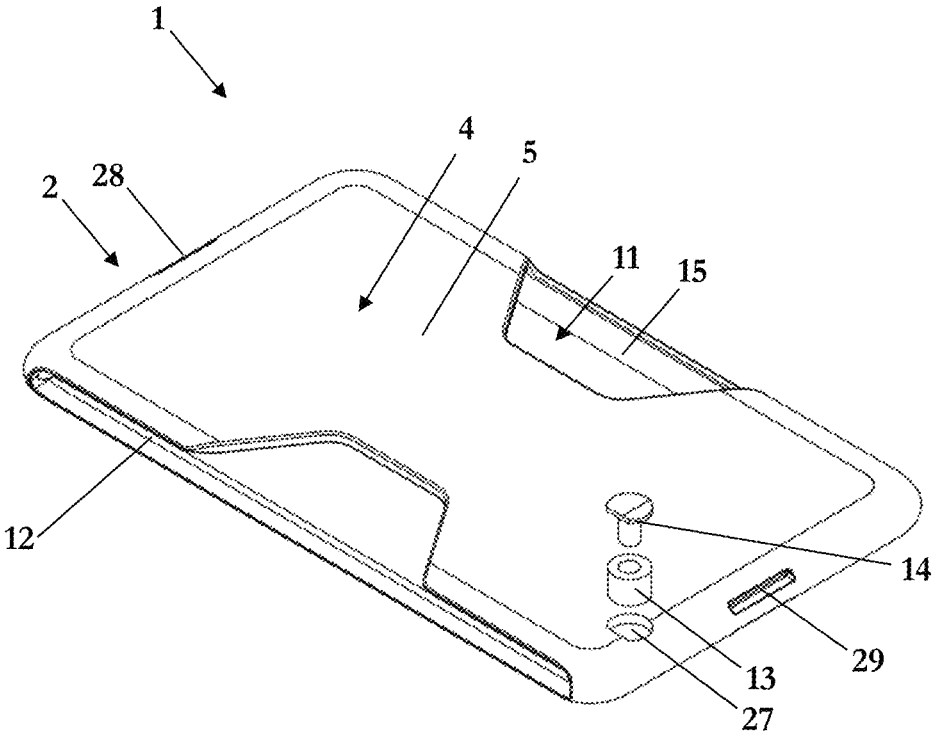
FIG. 2 is a perspective view of the wallet of FIG. 1.
Figure 3:
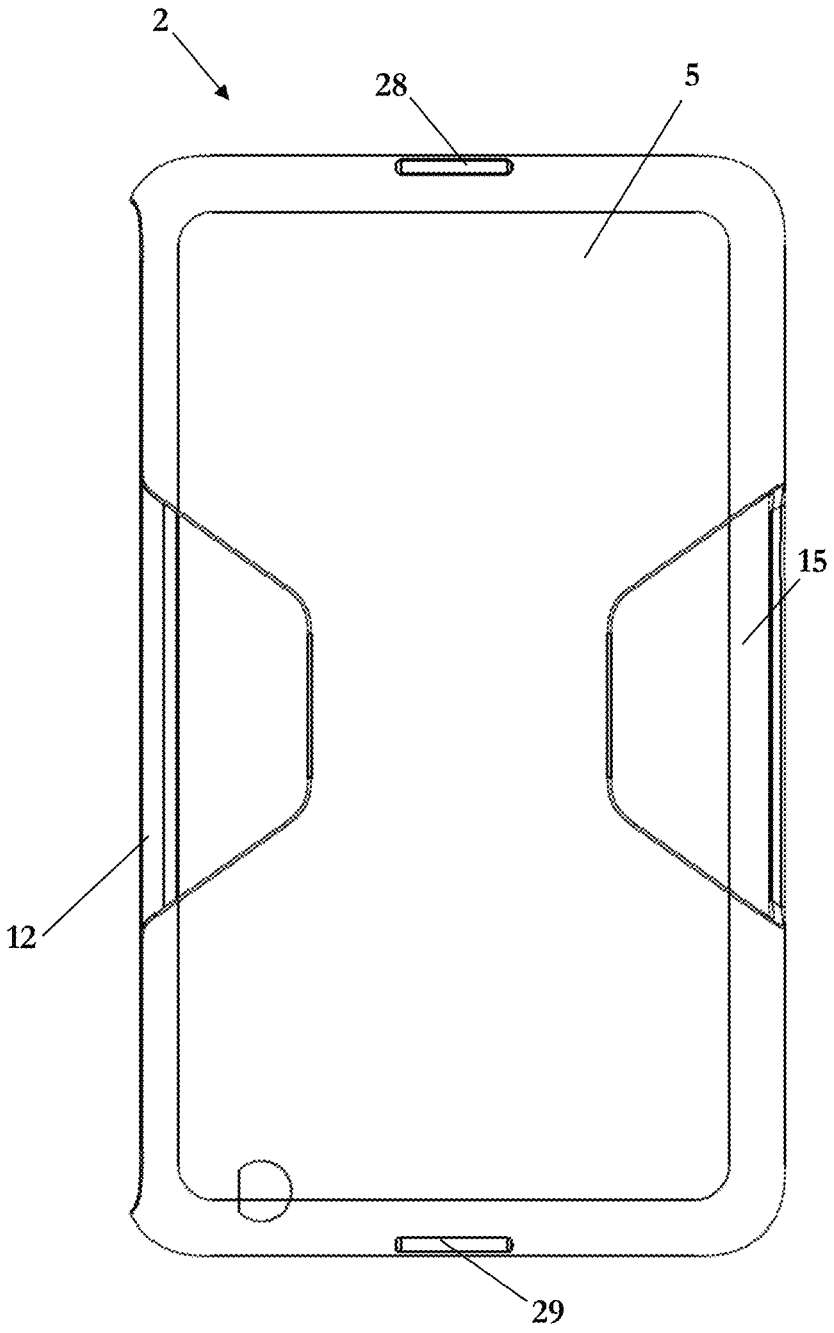
FIG. 3 is a front view of the wallet of FIG. 2.
Figure 4:
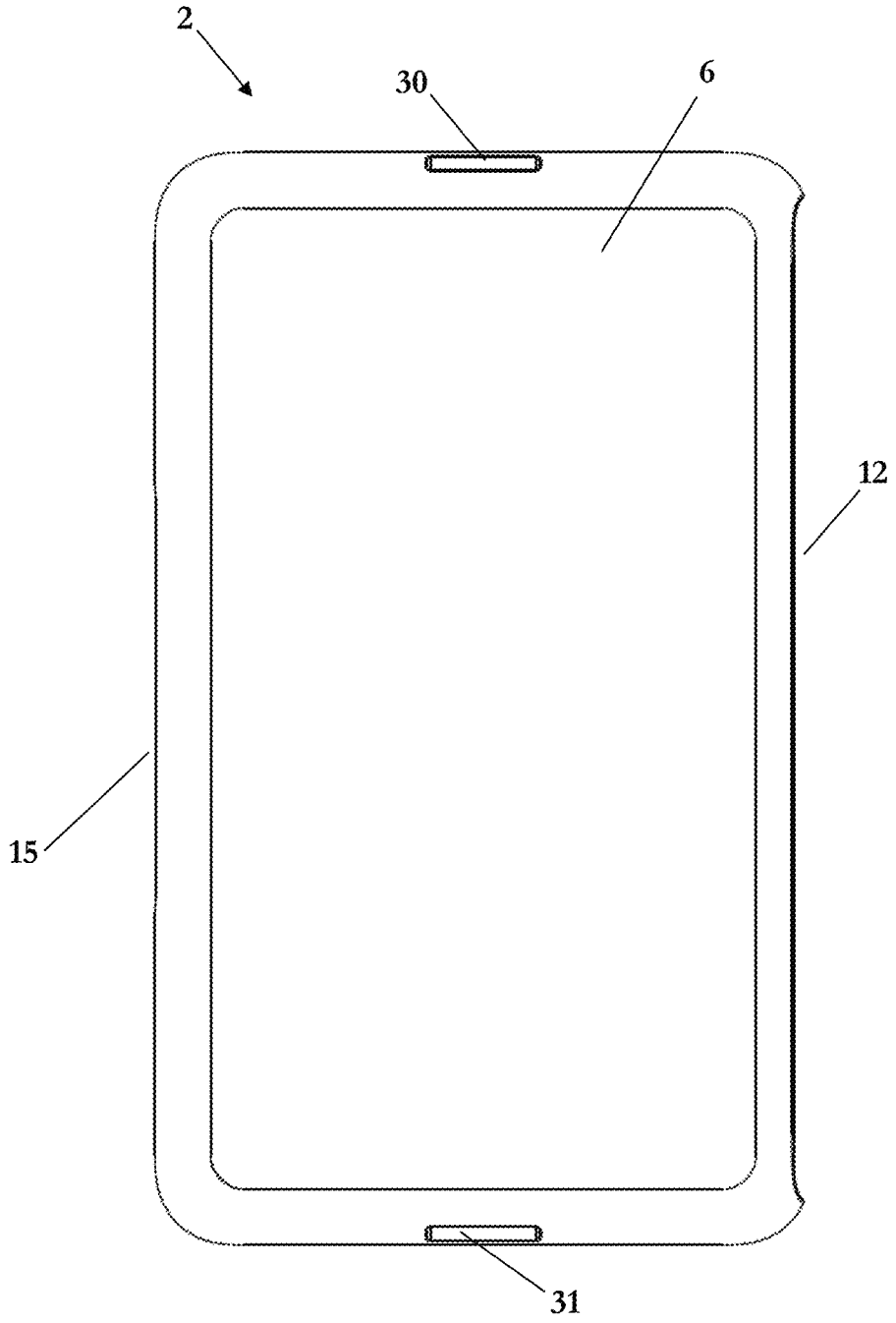
FIG. 4 is a rear view of the wallet of FIG. 2.
Figure 5:
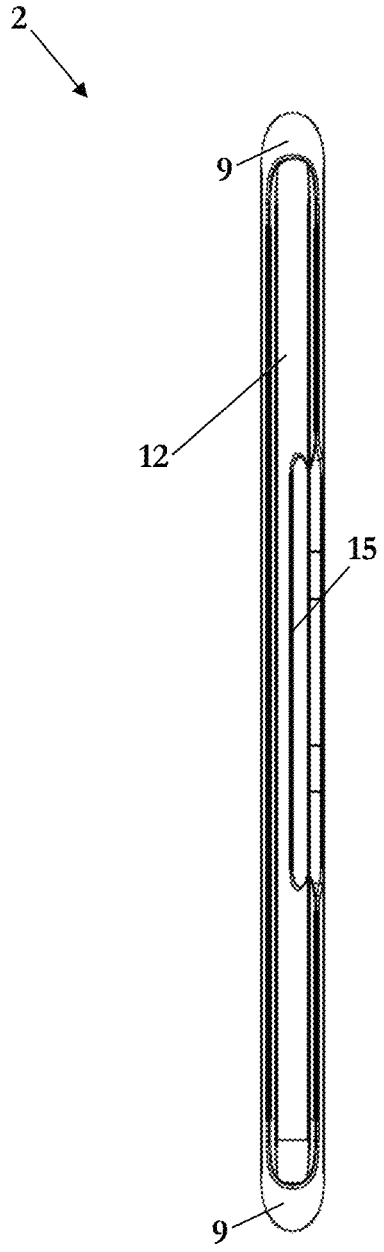
FIG. 5 is a left side view of the wallet of FIG. 2.
Figure 6:
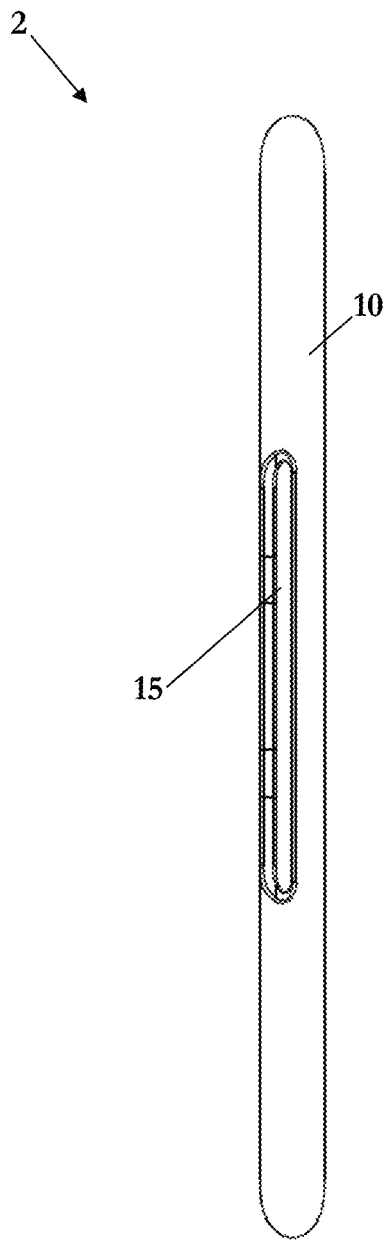
FIG. 6 is a right side view of the wallet of FIG. 2.
Figure 7:
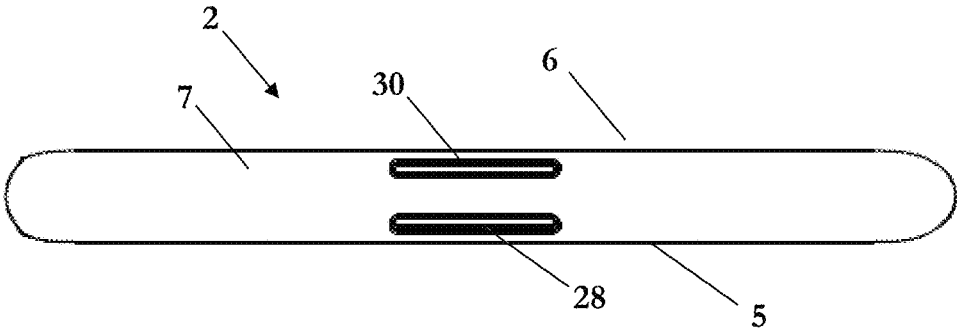
FIG. 7 is a top view of the wallet of FIG. 2.
Figure 8:
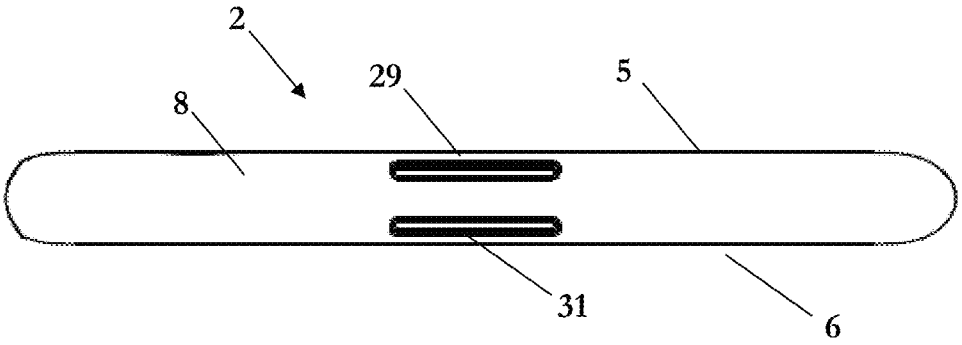
FIG. 8 is a bottom view of the wallet of FIG. 2.
Figure 9:
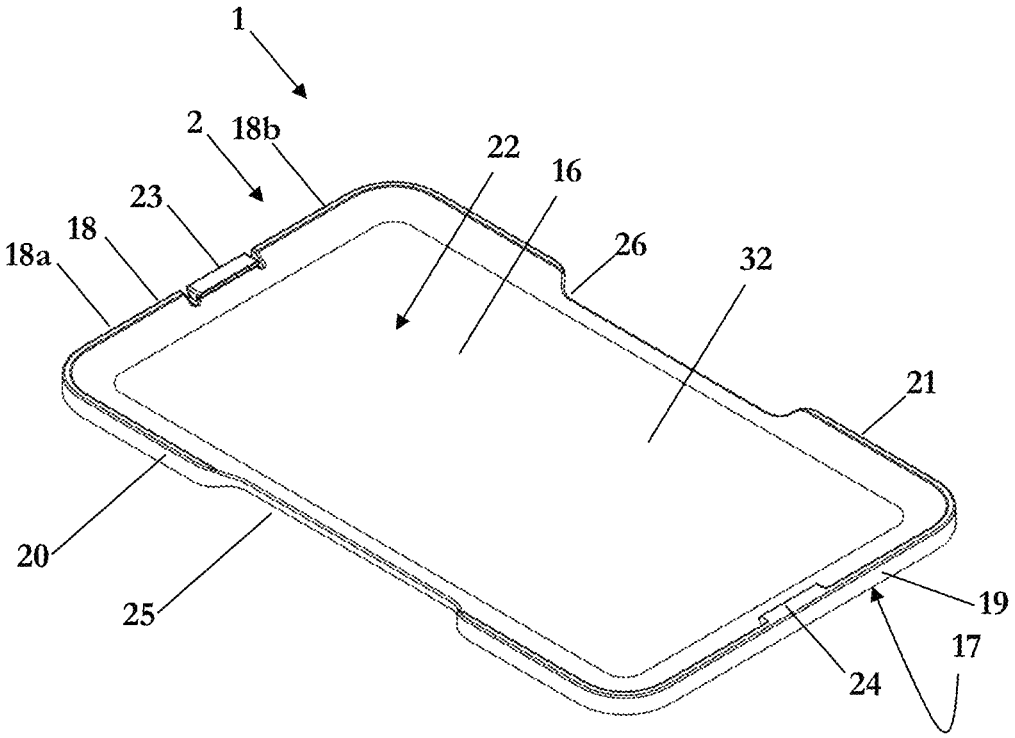
FIG. 9 is a perspective view of the holder of FIG. 1.
Figure 10:
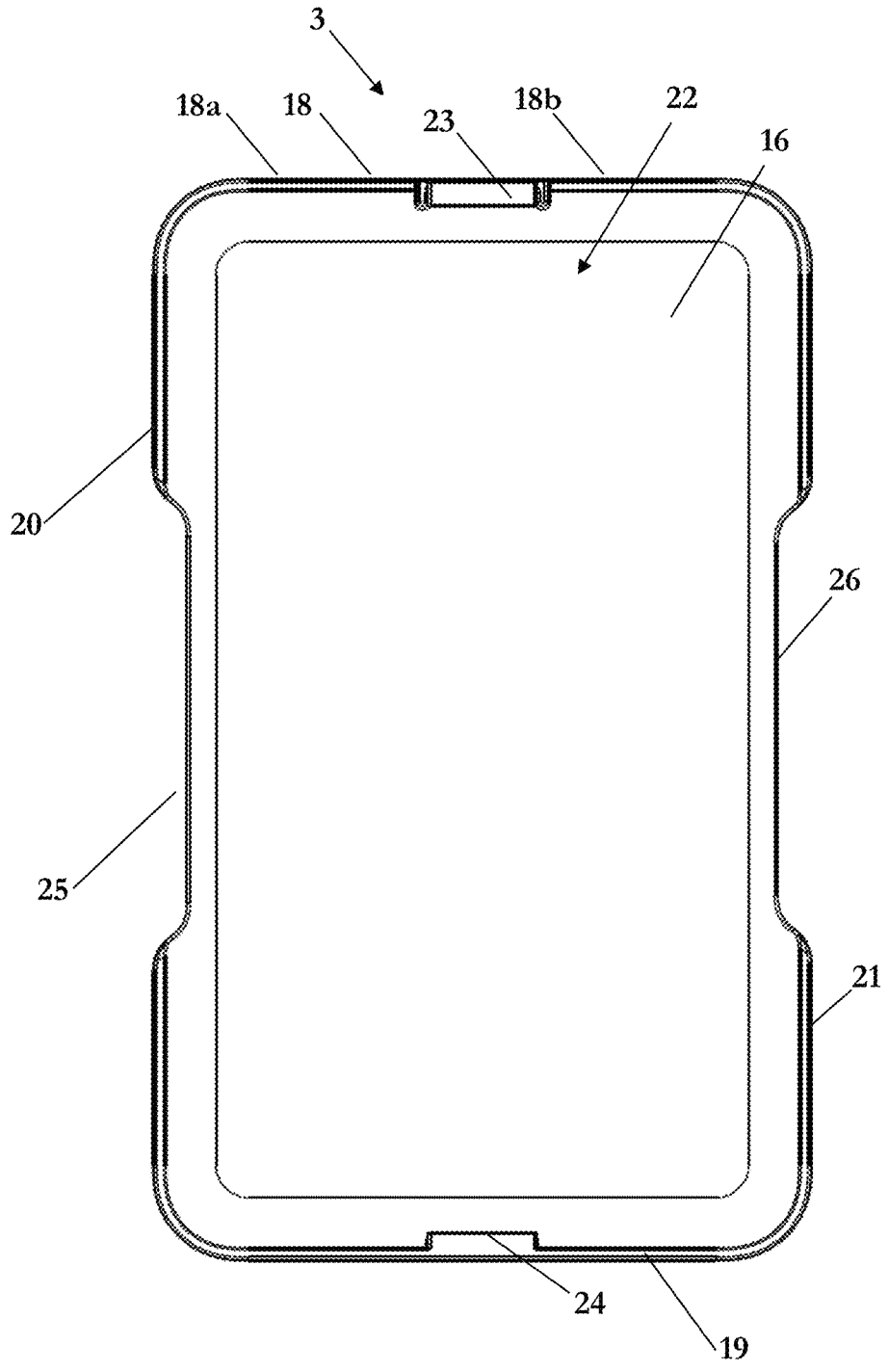
FIG. 10 is a front view of the holder of FIG. 9.
Figure 11:
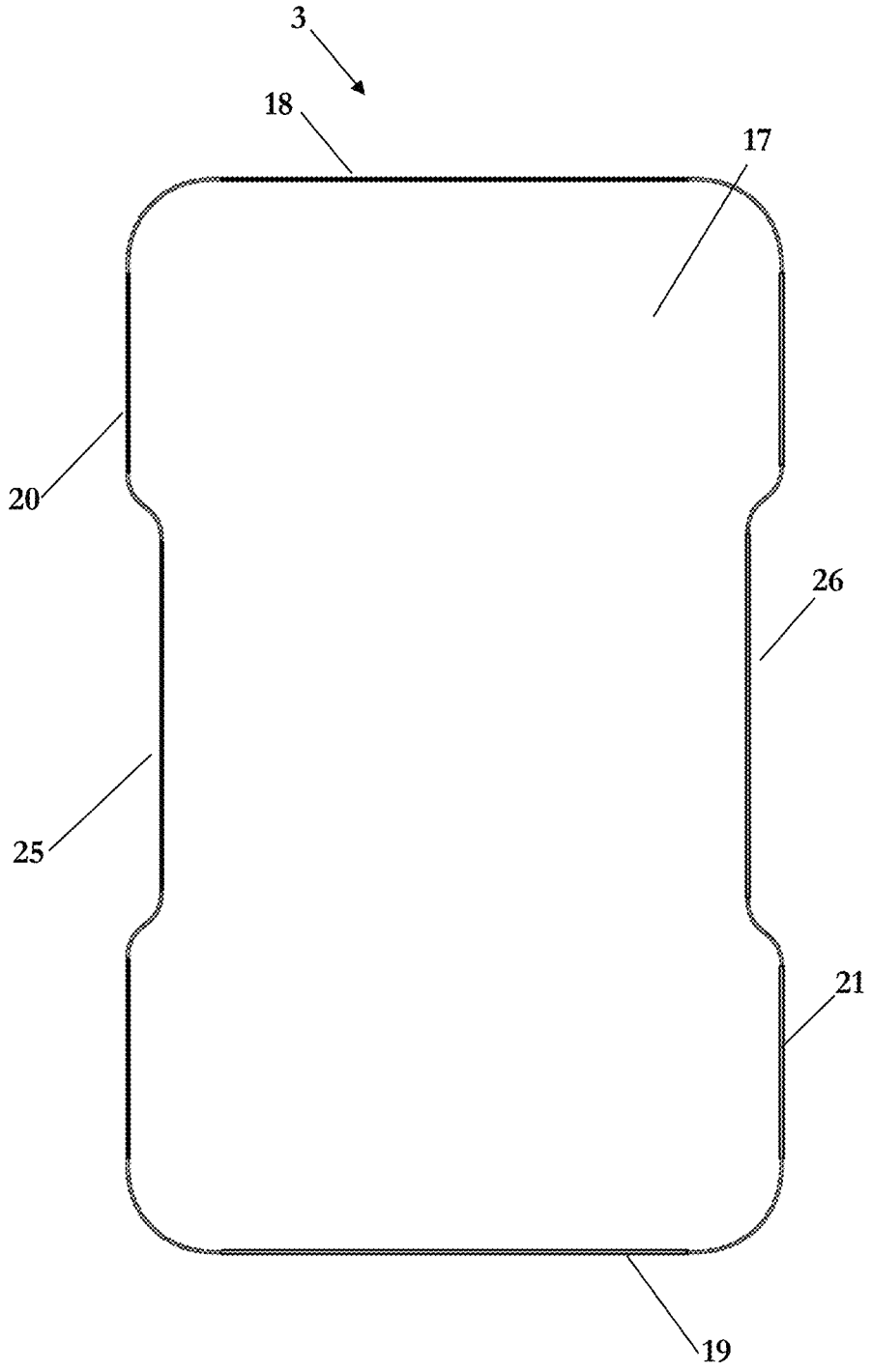
FIG. 11 is a rear view of the holder of FIG. 9.
Figure 12:
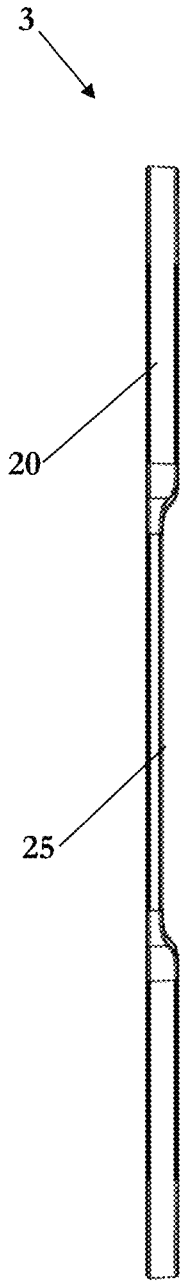
FIG. 12 is a left side view of the holder of FIG. 9.
Figure 13:
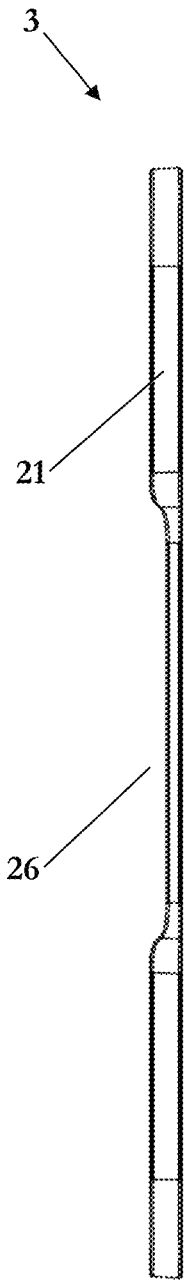
FIG. 13 is a right side view of the holder of FIG. 9.
Figure 14:
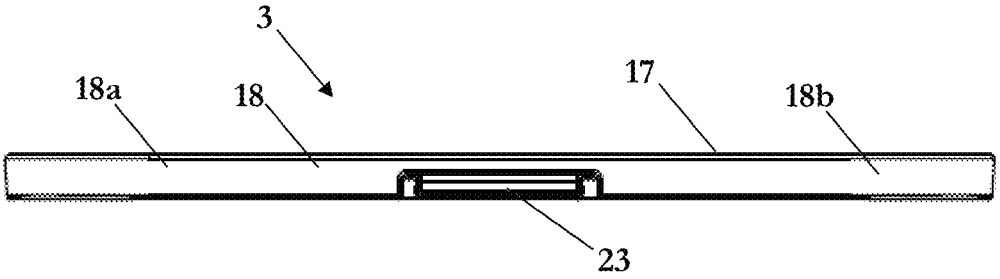
FIG. 14 is a top view of the holder of FIG. 9.
Figure 15:
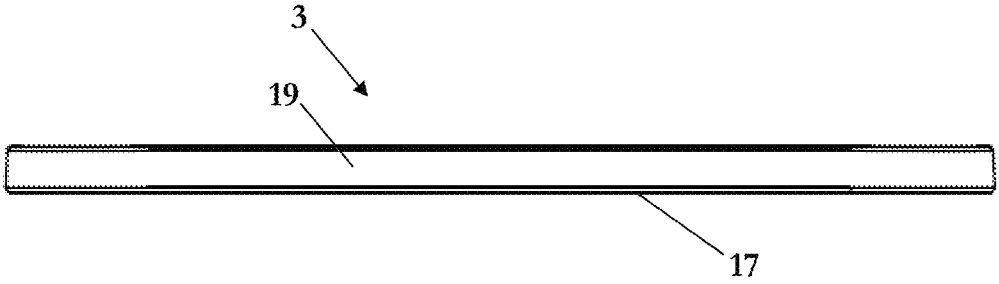
FIG. 15 is a bottom view of the holder of FIG. 9 in accordance with an embodiment of the invention.
Figure 16:
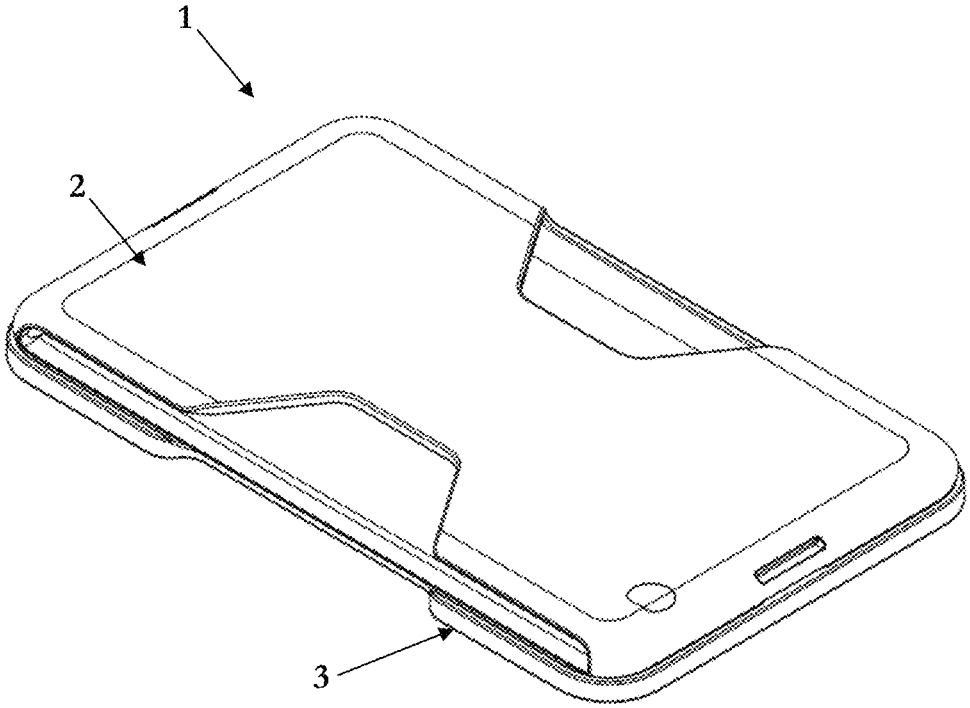
FIG. 16 is a perspective view of the wallet kit of FIG. 1 i, shown in a state with the wallet connected to the holder in a first orientation.
Figure 17:
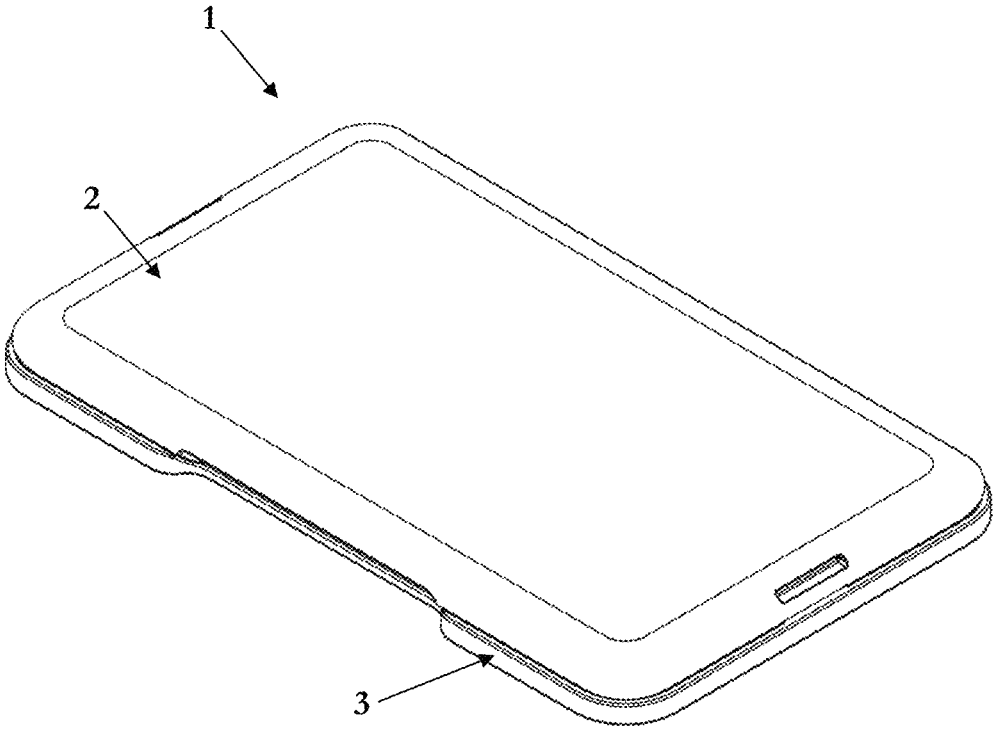
FIG. 17 is a perspective view of the wallet kit of FIG. 1, shown in a state with the wallet connected to the holder in a third orientation.

It is to be understood that the figures and descriptions of the present invention have been simplified to illustrate elements that are relevant for a clear understanding of the present invention, while eliminating, for purposes of clarity, many other elements which are conventional in this art. Those of ordinary skill in the art will recognize that other elements are desirable for implementing the present invention. However, because such elements are well known in the art, and because they do not facilitate a better understanding of the present invention, a discussion of such elements is not provided herein.

The present invention will now be described in detail on the basis of exemplary embodiments. It is noted that any numerical ranges disclosed herein are included to individually disclose every sub-range and number, both whole integer and partial fraction, within the disclosed range. For example, a disclosed range of 1-100 is intended to individually disclose 20-90, 40-80, 30.5-50.2, 20, 67.3, 84.512924, and every other range and number that falls within the recited range.

Referring now to FIGS. 1-17, the wallet 2 is formed by a housing 4 that has a front wallet wall 5 a rear wallet wall 6, an upper wallet wall 7, a lower wallet wall 8, a first wallet side wall 9, a second wallet side wall 10.

The upper wallet wall 7 connects an upper end of the rear wallet wall 6 to an upper end of the front wallet wall 5. The lower wallet wall 8 is opposite to the upper wallet wall 7, and connects a lower end of the rear wallet wall 6 to a lower end of the front wallet wall 5. The first wallet side wall 9 is between the upper wallet wall 7 and the lower wallet wall 8, and connects a first side end of the rear wallet wall 6 to a first side end of the front wallet wall 5. The second wallet side wall 10 is between the upper wallet wall 7 and the lower wallet wall 8, and connects a second side end of the rear wallet wall 6 to a second side end of the front wallet wall 5.

The front, rear, upper, lower, and second wallet side walls (5, 6, 7, 8, 10) form a wallet pocket 11 that is configured to hold a card, such as an electronic payment card, credit card, debit card, personal ID card, driver license, RFID card, electronic access card, and the like. A first wallet opening 12 is formed in the first wallet side wall 9, and is configured to accept insertion of the card into the wallet pocket 11.

The housing 4 is preferably formed from a rigid or hard material to create a rigid/hard shell which provides at least some impact protection as well as protection from being punctured by impacts with sharp objects. Examples of suitable hard/rigid materials include hardened plastic material, a rigid or semi-rigid plastic material, a rigid/hard rubber material, a polycarbonate material, a para-aramid material, wood, and any combination thereof, and may be any color or texture. Preferred materials include thermosetting plastics with a hard durometer having shore 30D to shore 100D, polycarbonate, poly(methyl methacrylate) ("PMMA"), acrylonitrile butadiene styrene ("ABS"), PMMA, polyethylene terephthalate ("PET"), high durometer thermoplastic elastomers ("TPEs") and thermoplastic polyurethanes ("TPUs") having shore 30D to shore 100D, and any combination thereof. Preferably, the hard/rigid material of the housing 4 is non-elastomeric. The hard protective shell may be designed to mimic the finish of existing mobile electronic devices, such as phones, MP3/4 players, tablets, laptops, and other mobile electronic devices. Many users like the feel of the original phone and would like to maintain that feel. Alternatively, the exterior of the housing 4 could be formed with a textured surface to make it easier to grip and hold the wallet 2.

The housing 4 may also include or be formed from at least one RF-shielding material that blocks, shields, or substantially interferes with RF (radio frequency) and/or RFID (radio-frequency identification) signals. Examples of suitable RF-shielding materials include metals (e.g., copper, nickel, a ferrous metal, ferrous sheet metal, steel plate, metal foils, and the like), a galvanized sheet metal plate, a sheet metal plate having a thickness of between 0.25 and 0.75 mm, and ferromagnetic materials.

Preferably the housing 4 is a single monobody unit formed, preferably molded, from a single piece of material. Alternatively, the housing 4 may be formed from two pieces of material that are bonded together, such as by ultrasonic welding or co-molding.

An elastomeric bumper 13 around an axle 14 is arranged inside the wallet pocket 11. In one embodiment, the elastomeric bumper 13 and axle 14 are inserted into the wallet pocket 11 through an axle opening 27 formed in the housing 4. The elastomeric bumper 13 is arranged in the wallet pocket 11 at a distance from the upper wallet wall 7 that is slightly less than the length dimension of the card to be arranged in the wallet pocket 11. In this way, the elastomeric bumper 13 deforms when the card is inserted into the wallet pocket 11 so as to apply pressure or force to the card to bias the card against the upper wallet wall 7. This biasing force securely retains the card in the wallet pocket 11 and prevents the card from accidentally falling out.

The elastomeric bumper 13 is preferably formed from a soft elastomeric material. Examples of suitable materials include thermoplastic elastomers ("TPEs"), thermoplastic polyurethane ("TPU"), polyolefins, silicone, rubber, and any combination thereof.

The axle 14 is preferably formed from any one of the rigid or hard materials listed above for the wallet 2, or any combination thereof.

The housing 4 also has a second wallet opening 15 formed in the front wall 5 which allows access to a card when arranged in the wallet pocket 11. This second wallet opening 15 can be used as a thumb or finger hole by a user to assist in removing objects inside the wallet pocket 11 via the first wallet opening 12.

In the embodiment in the drawings, the first wallet opening 12 is also formed the front wall 5 so that the front wall 5 has a shape like an hourglass as a result of the first and second wallet openings 12, 15.

The wallet 2 may be configured to attach directly to a mobile electronic device or mobile electronic device case, such as by an adhesive or adhesive strip arranged on the rear wallet wall 6. Preferably though, the wallet 2 does not include any adhesive or adhesive strip, but instead attaches to the electronic device or case via a holder 3, as will be described below.

Alternatively, the wallet 2 may be part of a wallet kit 1 that additionally includes a holder 3 for holding the wallet 2 to a mobile electronic device or mobile electronic device case, thereby eliminating the need for an adhesive or adhesive strip arranged on the rear wallet wall 6. The holder 3 has a front side 16 and a rear side 17. The front side 16 is configured to attach to the wallet 2. The rear side 17 is configured to attach to a rear of the mobile electronic device or a mobile electronic device case, such as by an adhesive or adhesive strip arranged on the rear side 17. In some arrangements, the adhesive may have a pull strength of at least 25 lbs., and more preferably at least 50 lbs. The holder 3 has a holder pocket 22 configured to accept the wallet 2.

In one embodiment, the holder 3 can be part of and integral with a case for a mobile electronic device. This would eliminate the need for an adhesive or adhesive strip arranged on the rear side 17 of the holder 3. In all other respects, the integral holder 3 would be similar to and have the same components of the separate adhesively attachable holder 3.

An attachment mechanism (23, 24) is configured to securely attach the wallet 2 to the holder 3. For example, the housing 4 of the wallet 2 may have a first attachment recess or opening 28, and the attachment mechanism (23, 24) may include a first protrusion 23 configured to fit into and be accepted by the first attachment recess or opening 28 when the wallet 2 is arranged in the holder pocket 22 with the rear wallet wall 6 located between the holder 3 and the front wallet wall 5.

The housing 4 of the wallet 2 may also have a second attachment recess or opening 29. The attachment mechanism (23, 24) may then further include a second protrusion 24 configured to fit into and be accepted by the second attachment recess or opening 29 when the wallet 2 is arranged in the holder pocket 22 with the rear wallet wall 6 located between the holder 3 and the front wallet wall 5.

Preferably the first and second protrusions 23, 24 are formed symmetrically, as are the first and second attachment recesses or openings 28, 29. In this way, the wallet 2 can be secured inside the holder pocket 22 with either the first protrusion 23 arranged in the first attachment recess or opening 28 and the second protrusion 24 arranged in the second attachment recess or opening 29, or the first protrusion 23 arranged in the second attachment recess or opening 29 and the second protrusion 24 arranged in the first attachment recess or opening 28. This allows the wallet 2 to be held by the holder 3 in at least two different orientations.

The housing 4 of the wallet 2 may also have a third attachment recess or opening 30. The first protrusion 23 of the attachment mechanism (23, 24) may then be configured to fit into and be accepted by the third attachment recess or opening 30 when the wallet 2 is arranged in the holder pocket 22 with the front wallet wall 5 located between the holder 3 and the rear wallet wall 6.

The housing 4 of the wallet 2 may also have a fourth attachment recess or opening 31. The second protrusion 24 of the attachment mechanism (23, 24) may then be configured to fit into and be accepted by the fourth attachment recess or opening 29 when the wallet 2 is arranged in the holder pocket 22 with the front wallet wall 5 located between the holder 3 and the rear wallet wall 6.

Preferably the first and second protrusions 23, 24 are formed symmetrically, as are the third and fourth attachment recesses or openings 30, 31. In this way, the wallet 2 can be secured inside the holder pocket 22 with either the first protrusion 23 arranged in the third attachment recess or opening 30 and the second protrusion 24 arranged in the fourth attachment recess or opening 31, or the first protrusion 23 arranged in the fourth attachment recess or opening 31 and the second protrusion 24 arranged in the third attachment recess or opening 30. This allows the wallet 2 to be held by the holder 3 in an additional two different orientations. In this way, the wallet 2 may be held by the holder 3 in four different orientations.

When the wallet 2 is arranged in the holder pocket 22 in either of the first or second orientations with the rear wallet wall 6 located between the holder 3 and the front wallet wall 5 (FIG. 16), the portion of the first wallet opening 12 formed in the front wallet wall 5 and the second wallet opening 15 are able to be accessed by a user so that one or more cards can be inserted into and removed from the wallet pocket 11.

On the other hand, when the wallet 2 is arranged in the holder pocket 22 in either of the third or fourth orientations with the front wallet wall 5 located between the holder 3 and the rear wallet wall 6 (FIG. 17), then the portion of the first wallet opening 12 formed in the front wallet wall 5 and the second wallet opening 15 are covered by the rear wallet wall 6.

While a user may be able to insert cards into the wallet pocket 11 when the wallet 2 is arranged in the holder pocket 22 in either of the third or fourth orientations (FIG. 17), such a user cannot access any of the cards arranged in the wallet pocket 11 to remove them without first detaching the wallet 2 from the holder 3. The covering by the rear wallet wall 6 thus prevents cards from being accidentally removed from the wallet pocket 11 or easily removed from the wallet pocket 11 by a thief. This covering also provides visual security, as the cards may be fully covered, allowing the user to feel safer in public.

The holder 3 further has a rear holder wall 32. An upper holder wall 18 extends from an upper end of the rear holder wall 32. A lower holder wall 19 is opposite to the upper holder wall 18, and extends from a lower end of the rear holder wall 32. A first holder side wall 20 is arranged between the upper holder wall 18 and the lower holder wall 19, and extends from the rear holder wall 32. A second holder side wall 21 is arranged between the upper holder wall 18 and the lower holder wall 19, and extends from the rear holder wall 32. The holder pocket 22 is formed by the rear holder wall 32, the upper holder wall 18, the lower holder wall 19, the first holder side wall 20, and the second holder side wall 21.

While the embodiments of the drawings show the rear holder wall 32 as a solid wall, the rear holder wall 32 may alternatively include an opening or window to expose the rear side of the case or mobile electronic device to assist in wireless electrical charging.

Preferably the first protrusion 23 extends from the upper end of the rear holder wall 32, and is separate from the upper holder wall 18 and arranged between a first part 18*a* of the upper holder wall 18 and a second part 18*b* of the upper holder wall 18. This allows the first protrusion 23 to be a flexible protrusion that bends or rotates, with respect to the rear holder wall 32, away from the upper holder wall 18. This flexible protrusion 23 makes it easier to connect the wallet 2 to the holder 3 and to remove the wallet 2 from the holder 3.

The second protrusion 24 may extend from the lower holder wall 19, the first protrusion being part of and integral to the lower holder wall 19. In this way the second protrusion 24 is an inflexible rigid protrusion that does not bend or rotate with respect to the rear holder wall 32 or the lower holder wall 19. This rigid protrusion 24 assists in securely connect the wallet 2 to the holder 3 so that the wallet 2 does not accidentally or unintentionally disconnect from the holder 3.

While the embodiments in the drawings show the first protrusion 23 as a flexible protrusion, the first protrusion 23 may instead be formed as a rigid protrusion. Similarly, while the embodiments in the drawings show the second protrusion 24 as an inflexible rigid protrusion, the second protrusion 24 may instead be formed as a flexible protrusion. As such, both the first and second protrusions 23, 24 may be formed as flexible protrusions, or both the first and second protrusion 23, 24 may be formed as rigid protrusions. Preferably, at least one of the first and second protrusions 23, 24 is a flexible protrusion to assist in attaching and removing the wallet 2 to and from the holder 3.

The holder 3 may also include a first holder opening 25 formed in the first holder side wall 20 to correspond to and align with the first wallet opening 12 when the wallet 2 is arranged in the holder pocket 22 in the first or fourth orientations, or the second wallet opening 15 when the wallet 2 is arranged in the holder pocket 22 in the second or third orientations.

As shown, the holder 3 optionally may include a second holder opening 26 formed in the second holder side wall 21 to correspond to and align with second wallet opening 15 when the wallet 2 is arranged in the holder pocket 22 in the first or fourth orientations, or the first wallet opening 12 when the wallet 2 is arranged in the holder pocket 22 in the second or third orientations.

While the embodiments of the drawings show four attachment recesses or openings 28-31, the housing 4 may alternatively have only two attachment recesses or openings, each attachment recess or opening being formed in the center of the upper and lower wallet walls 7, 8 rather than offset therefrom. This would allow the wallet 2 to still be arranged in the four orientations described above, but with fewer recesses or openings that could potentially get clogged with debris when not in use.

In some alternative arrangements, the holder 3 may include additional protrusions on holder rear side 17, which may be but are not limited to being similar to flexible and rigid protrusions 23, 24 and their alternative configurations discussed previously herein. Such arrangements would allow the holder 3 to be attached to a mobile device or a case for a mobile device via recesses or openings on such mobile device or mobile device case corresponding to the additional protrusions on the holder rear side 17 without the use of an adhesive.

The outside surface of the wallet 2 may be provided with a scratch resistant UV hardcoat, which resists scratches and prevents discoloration of the case due to UV exposure.

The outside surface of the wallet 2 may have an antimicrobial material coated on one or more surfaces (e.g., one or more exterior surfaces of the wallet 2 facing away from the wallet pocket 11) or embedded within the housing 4.

Examples of antimicrobial materials include silver or silver alloy (e.g., silver sodium hydrogen zirconium phosphate), copper or copper alloy, organosilanes, quaternary ammonium compounds (e.g., dimethyloctadecyl (3-trimethoxysilyl propyl) ammonium chloride, alkyldimethylbenzylammonium chloride, and didecyldimethylammonium chloride), chlorhexidine, chlorhexidine incorporated hydroxyapatite materials, chlorhexidine-containing polymers (e.g., chlorhexidine-containing polylactide), and antibiotics (e.g., gentamicin, cephalothin, carbenicillin, amoxicillin, cefamandol, tobramycin, vancomycin).

Examples of antimicrobial coatings include coatings containing one or more of the above antimicrobial materials, chlorhexidine-containing polylactide coatings on an anodized surface, and polymer and calcium phosphate coatings with chlorhexidine.

In addition, or alternatively, the housing 4 may include an antimicrobial surface treatment. For example, one or more surfaces (e.g., one or more exterior surfaces of the wallet 2 facing away from the wallet pocket 11) may be formed as or made to be a superhydrophobic surface—such as a low energy, generally rough surface on which water has a contact angle (i.e., the angle at which the liquid-vapor interface meets the solid-liquid interface) of >150°.

Forming the housing 4 with an antimicrobial material, antimicrobial coating, antimicrobial surface treatment, or any combination thereof helps to keep the outside of the wallet 2 clean and reduce/minimize the presence of microbes (e.g., bacteria, fungi, viruses, etc.), thereby helping to prevent the hand-to-hand spread of related sicknesses, illnesses, or diseases.

The holder 3 optionally may be configured so that there are no gaps between the housing 4 of the wallet 2 and the surfaces of the holder 3 forming the holder pocket 22. This enables the holder 3 to have a very solid connection to the wallet 2.

The walls 5, 6, 7, 8, 9, 10, 18, 19, 20, 21, 32 of each of the housing 4 and holder 3 are preferably 0.5-4.0 mm thick. Preferably one or more of the walls is 0.6-3.0 mm thick. More preferably, one or more of the walls is 0.8-2.0 mm thick. Even more preferably, one or more of the walls is 0.9-1.3 mm thick.

The holder 3 may be formed from any of the rigid or hard materials listed above for the wallet 2, or any combination thereof. Preferably the holder 2 is not formed from and does not include any of the RF-shielding materials listed above so that the holder 3 does not interfere with wireless electrical charging of an electronic device connected to the holder 3. As such, it is preferably to form the holder 2 from a rigid or hard nonmetallic material that is RF-transparent such that RF transmissions can be transmitted through the holder 3. Examples of suitable nonmetallic RF-transparent hard/rigid materials include hardened plastic material, a rigid or semi-rigid plastic material, a rigid/hard rubber material, a polycarbonate material, a para-aramid material, wood, glass, quartz, and any combination thereof, and may be any color or texture. Preferred materials include thermosetting plastics with a hard durometer having shore 30D to shore 100D, polycarbonate, poly(methyl methacrylate) ("PMMA"), acrylonitrile butadiene styrene ("ABS"), PMMA, polyethylene terephthalate ("PET"), high durometer thermoplastic elastomers ("TPEs") and thermoplastic polyurethanes ("TPUs") having shore 30D to shore 100D, and any combination thereof. The holder 3 may be designed to mimic the finish of existing mobile devices, such as phones, MP3/4 players, tablets, laptops, electronic safety devices, and other mobile electronic devices. Many users like the feel of the original electronic device and would like to maintain that feel. The material used for the holder 3 preferably has a low coefficient of friction. This allows the electronic device attached to the holder 3 to be slipped in and out of pockets easily with little resistance and without gripping to clothing materials like elastomeric materials do.

Referring now to FIGS. 18A-33, a wallet kit 101 includes a wallet 102 and a holder 103 that is attachable to the wallet 102 such that a rear wallet wall 106 or a front wallet wall 105 of the wallet faces a holder pocket 122 of the holder 103. Such attachment of the wallet 102 and the holder 103 is possible in two orientations of each of these interfaces as described previously herein with respect to wallet 1.

The wallet 102 is the same as the wallet 2 or the variations of the wallet 2 described previously herein with specific exceptions. First, the wallet 102 includes an upper wallet part 133 attachable to lower wallet part 134 to define wallet housing 104. As in the example shown, the upper and lower wallet parts 133, 134 may be snapped together. In some arrangements, the upper and lower wallet parts may be attached by way of an interference fit, by an adhesive, or by any combination of a snap-fit, an interference fit, and an adhesive.

Second, the wallet housing 104 defines a first wallet opening 112 that is longer at the interface of the first wallet opening with a front wallet wall 105 of the wallet housing than the corresponding interface of the wallet 2. In this manner, the first wallet opening 112 provides access to a greater surface area of an exposed surface of a card that may be inserted into a wallet pocket 111 of the wallet 102 than is provided by the first wallet opening 12.

Figure 18A:
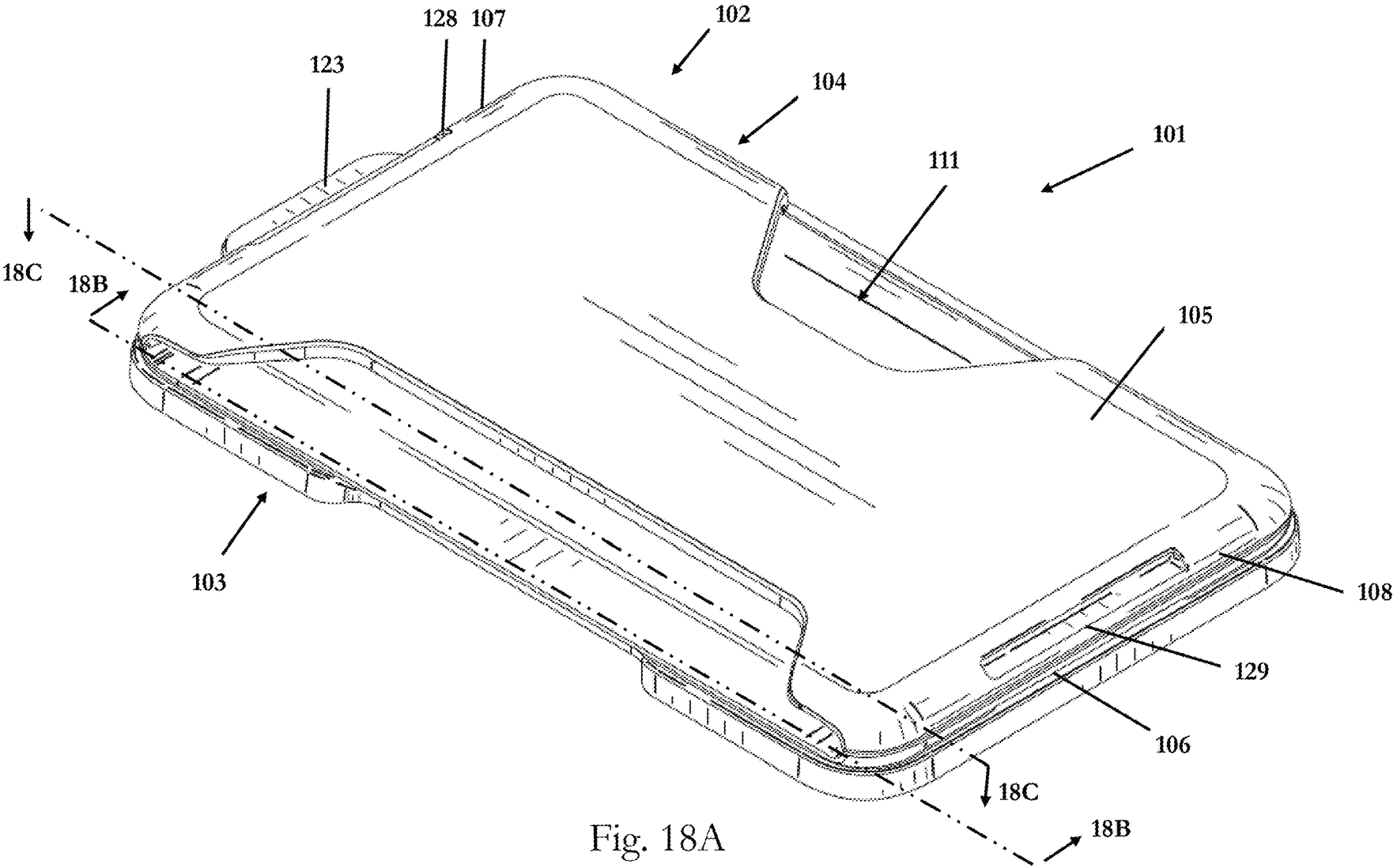
FIG. 18A is a perspective view of a wallet kit in accordance with another embodiment of the invention, shown in a state with a wallet of the kit connected to a holder of the kit.
Figure 18B:
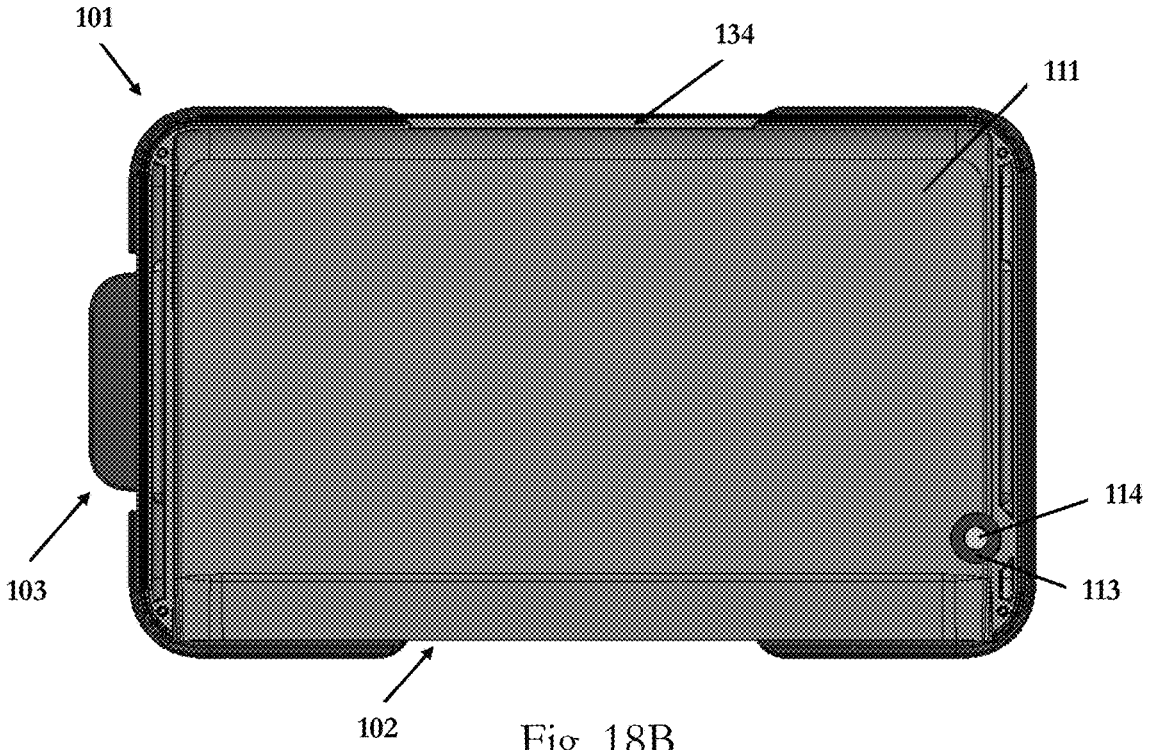
FIG. 18B is a front cross-sectional view of the wallet kit taken along lines 18B-18B as shown in FIG. 18A.
Figure 18C:
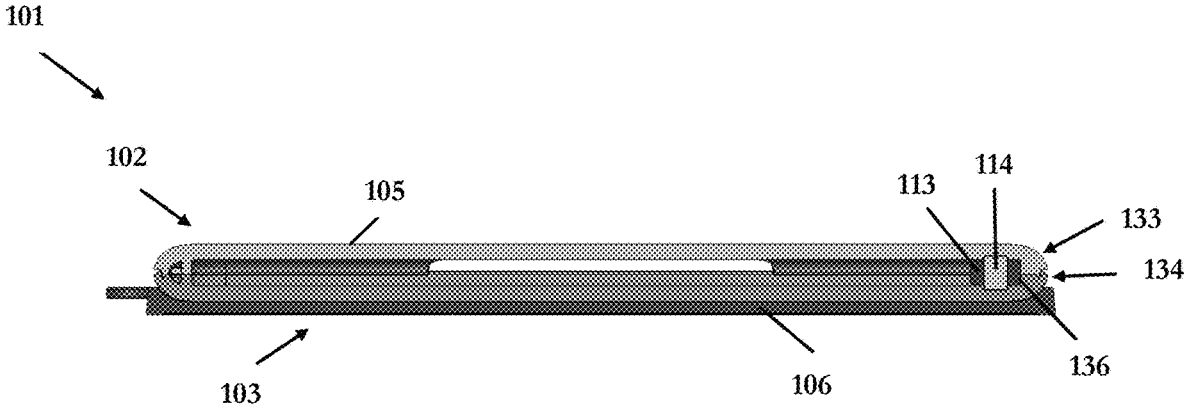
FIG. 18C is a left side cross-sectional view of the wallet kit taken along lines 18C-18C as shown in FIG. 18A.
Figure 19:
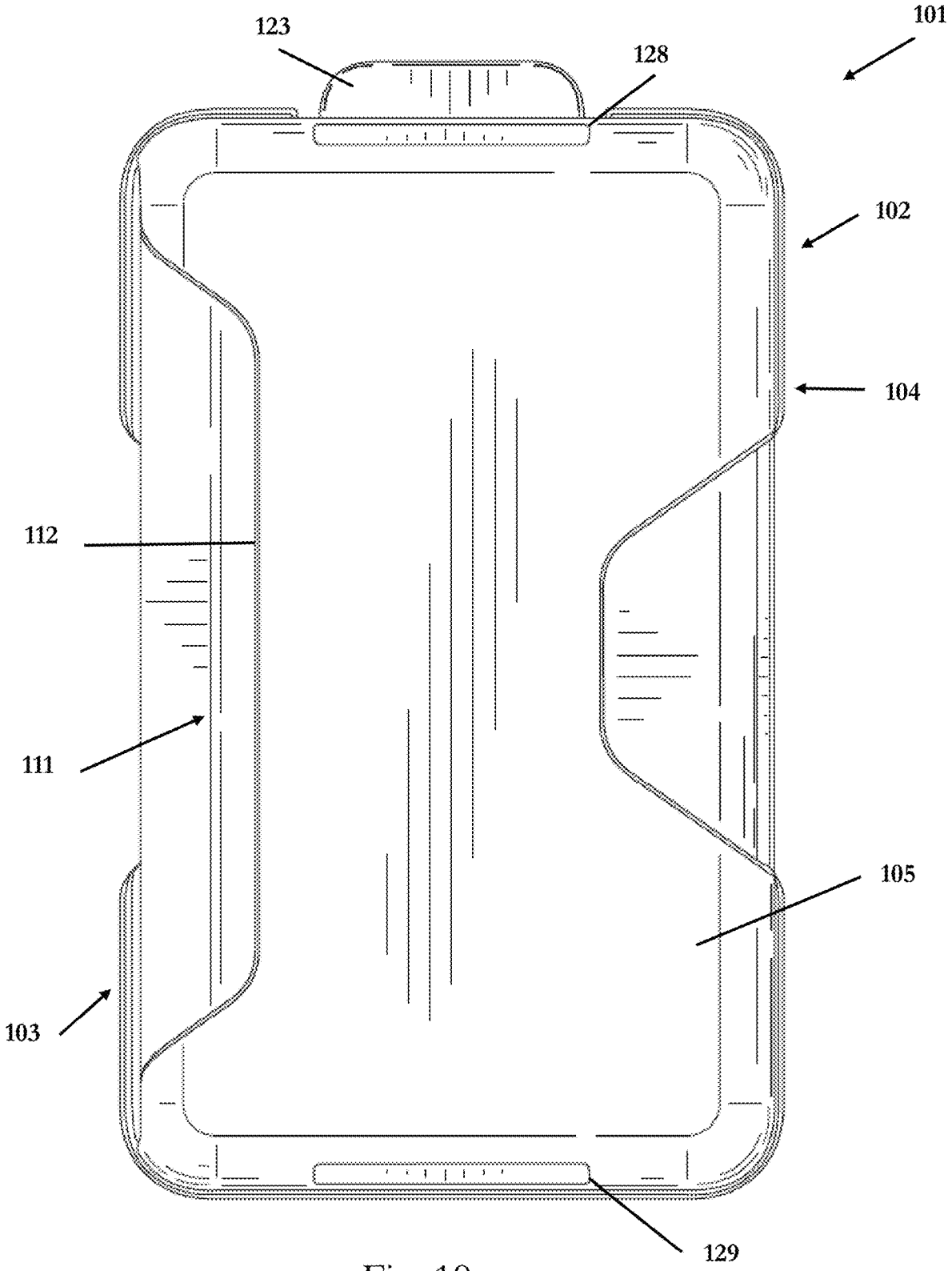
FIG. 19 is a front view of the wallet kit of FIG. 18A.
Figure 20:
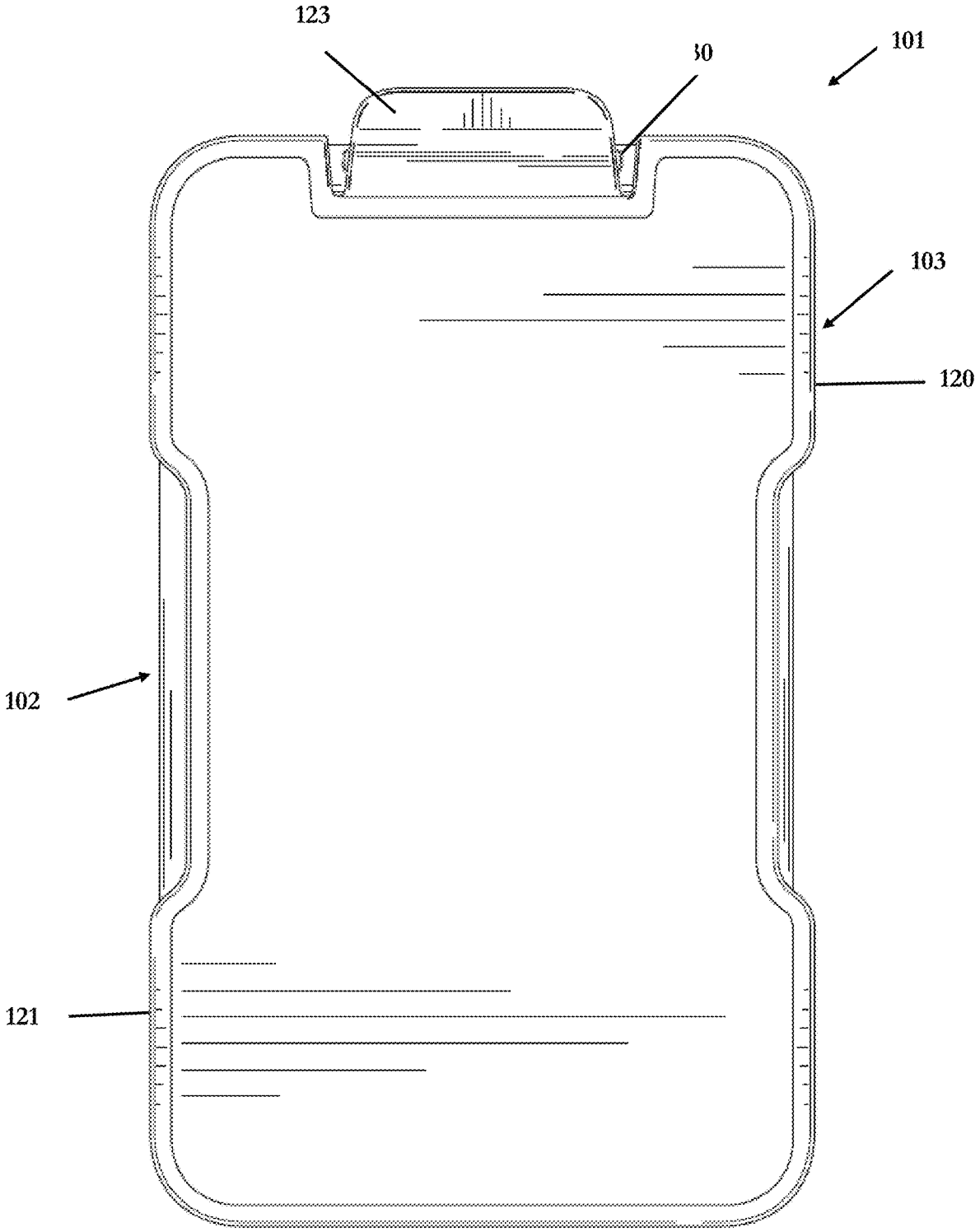
FIG. 20 is a rear view of the wallet kit of FIG. 18A.
Figure 21:
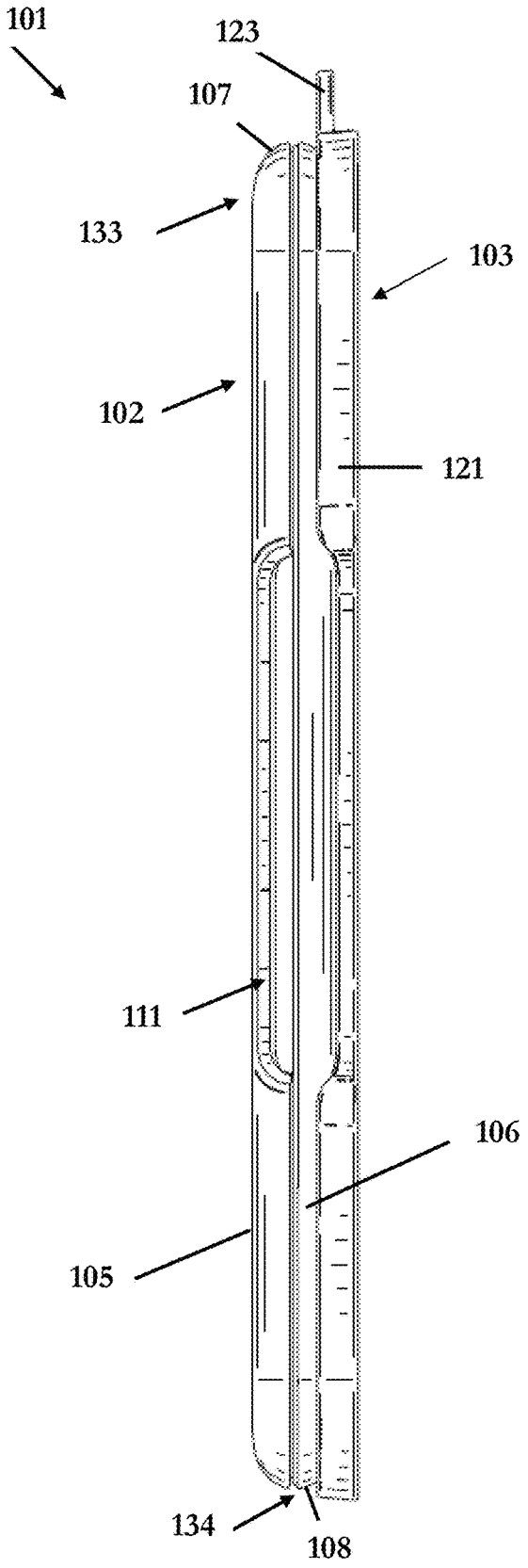
FIG. 21 is a right side view of the wallet kit of FIG. 18A.
Figure 22:
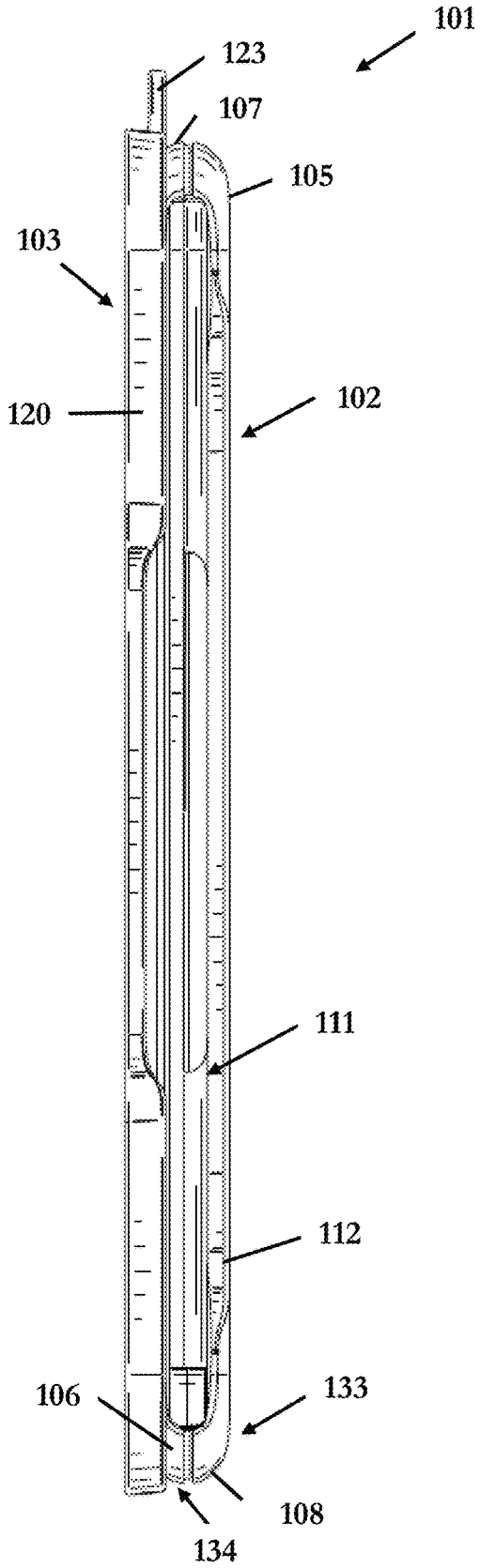
FIG. 22 is a left side view of the wallet kit of FIG. 18A.
Figure 23:
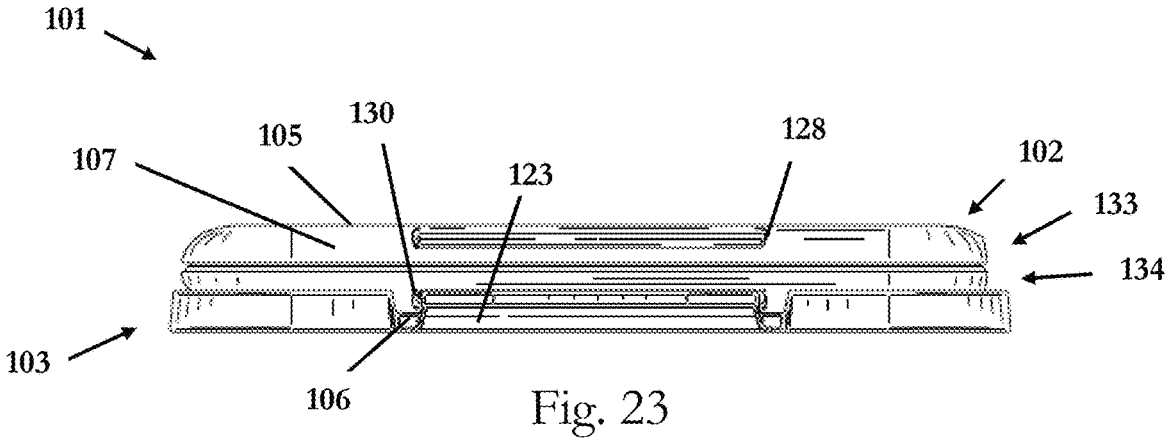
FIG. 23 is a top view of the wallet kit of FIG. 18A.
Figure 24:
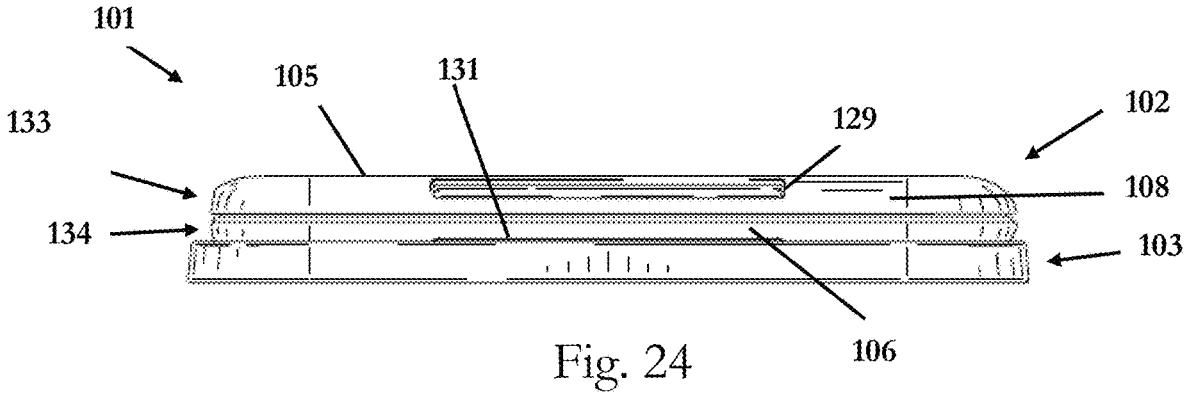
FIG. 24 is a bottom view of the wallet kit of FIG. 18A.
Figure 25:
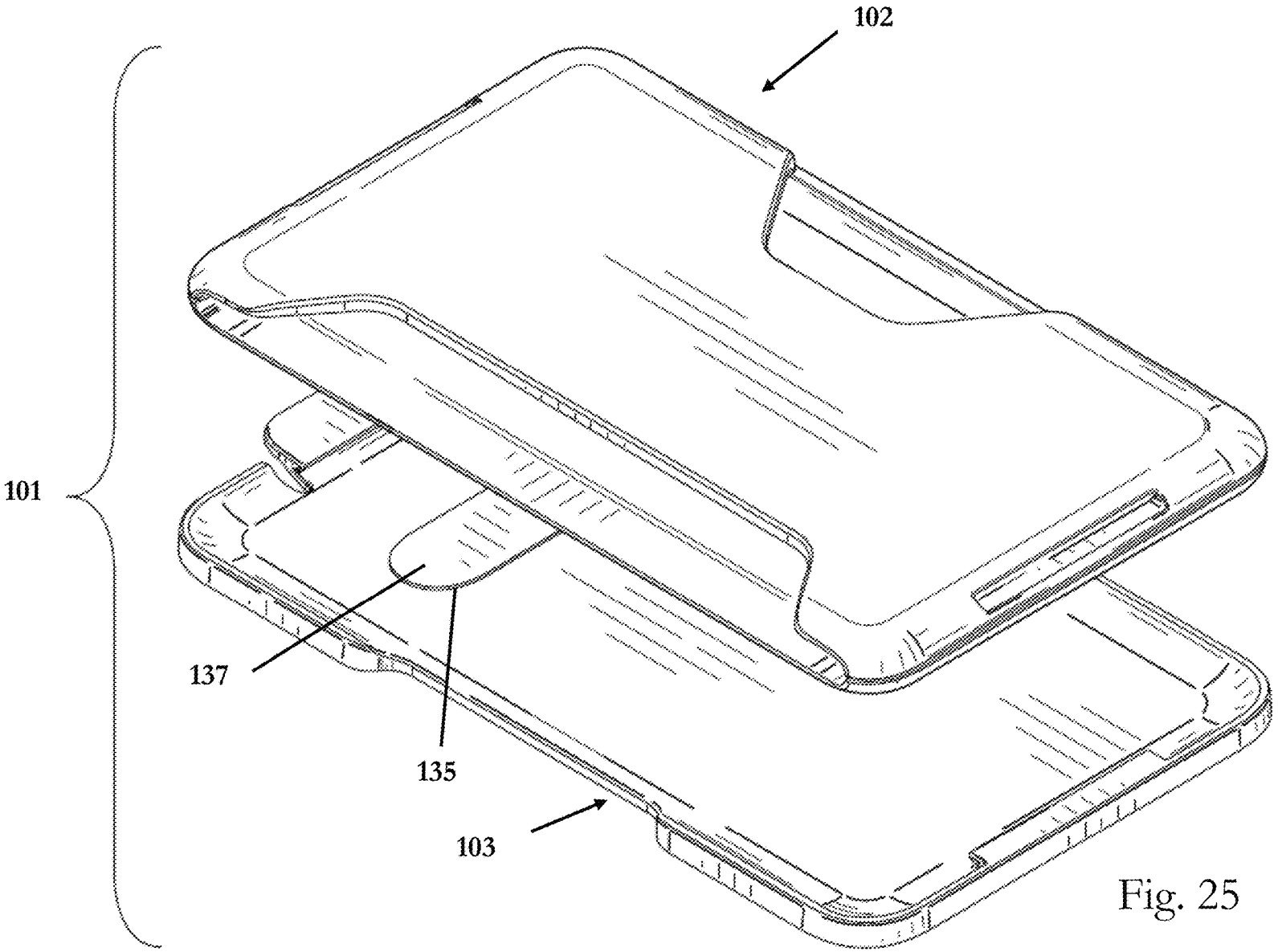
FIG. 25 is an exploded perspective view of the wallet kit of FIG. 18A, shown in a state with the wallet detached from the holder.
Figure 26:
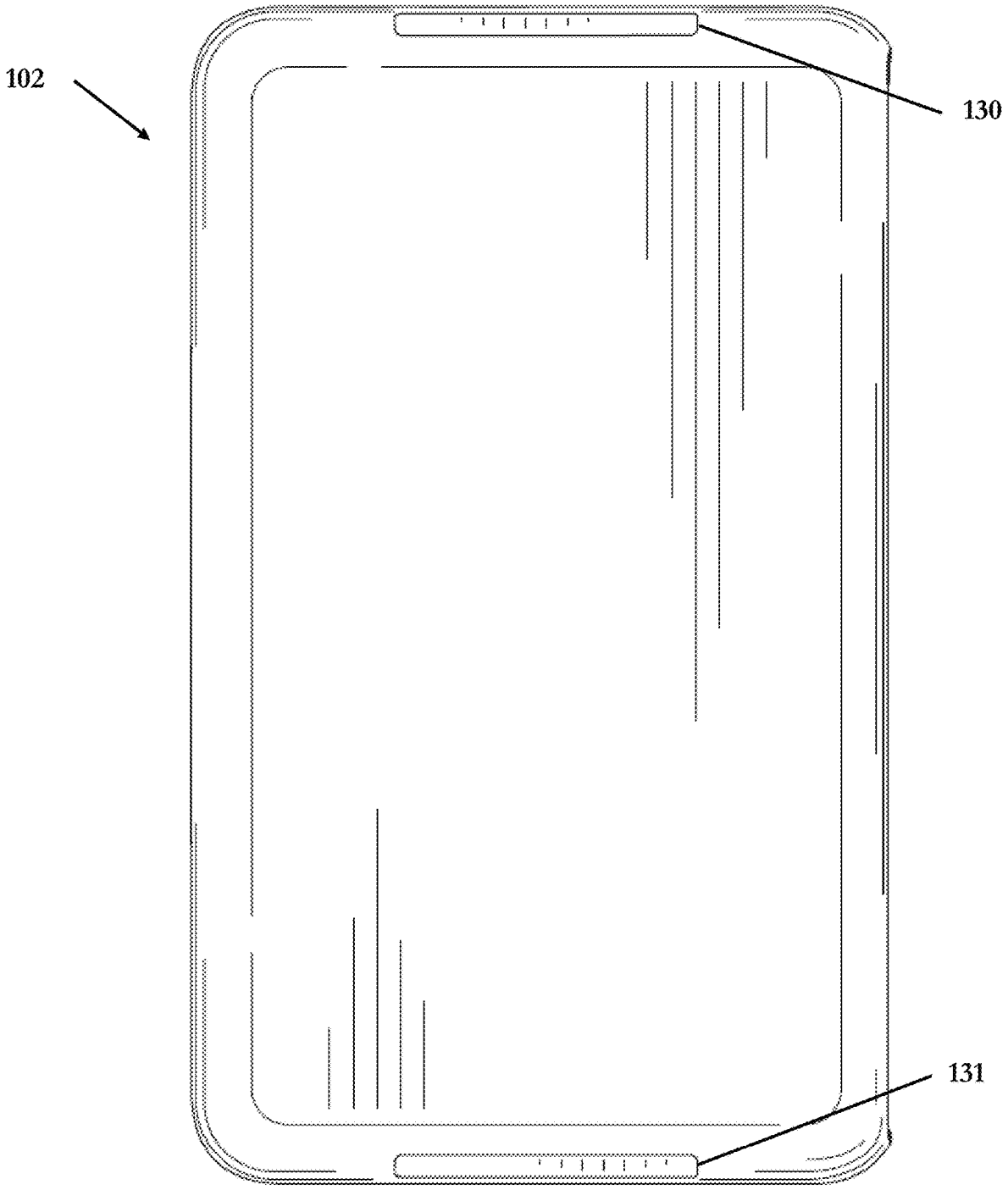
FIG. 26 is a rear view of the wallet of FIG. 18A.
Figure 27:
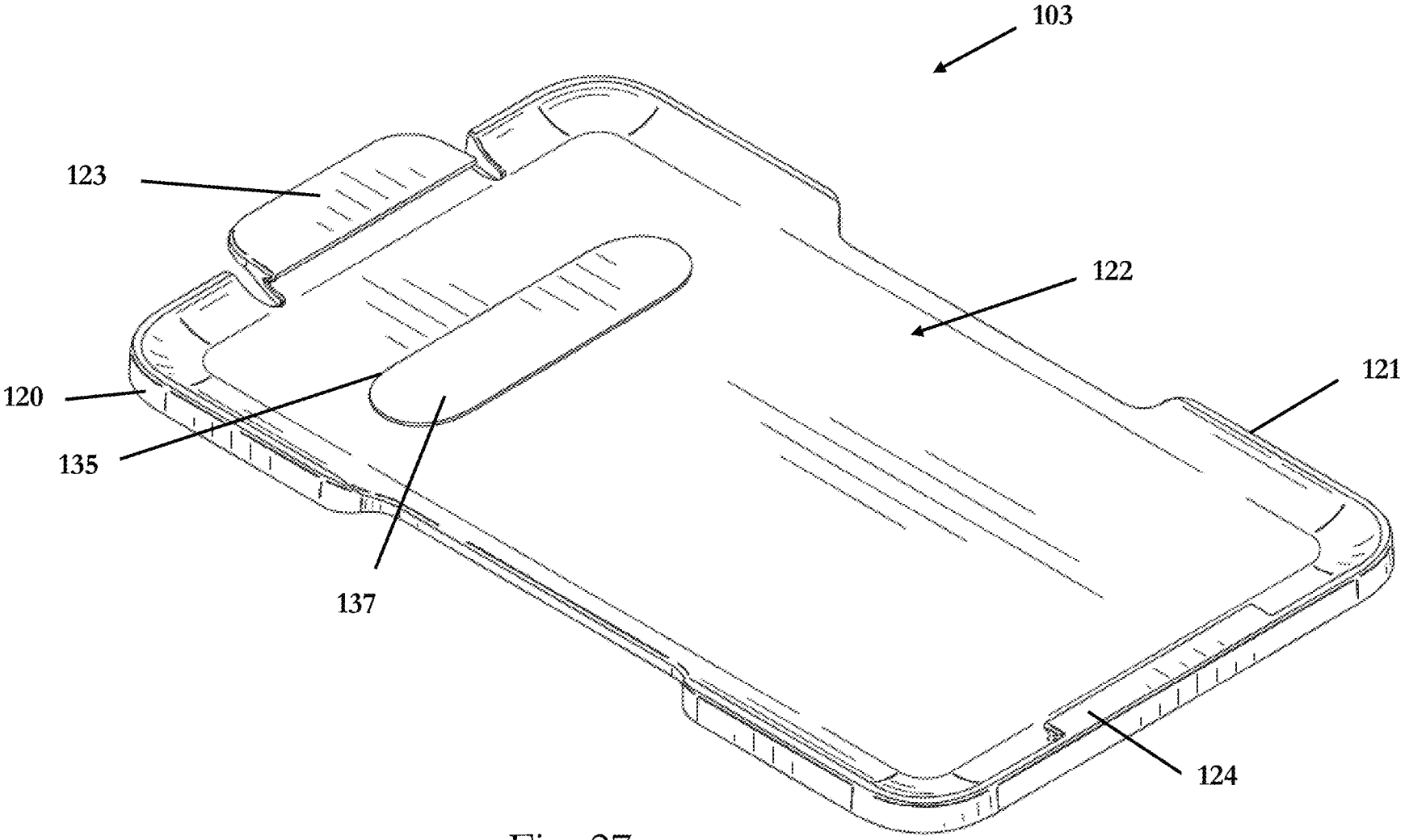
FIG. 27 is a perspective view of the holder of FIG. 18A.
Figure 28:
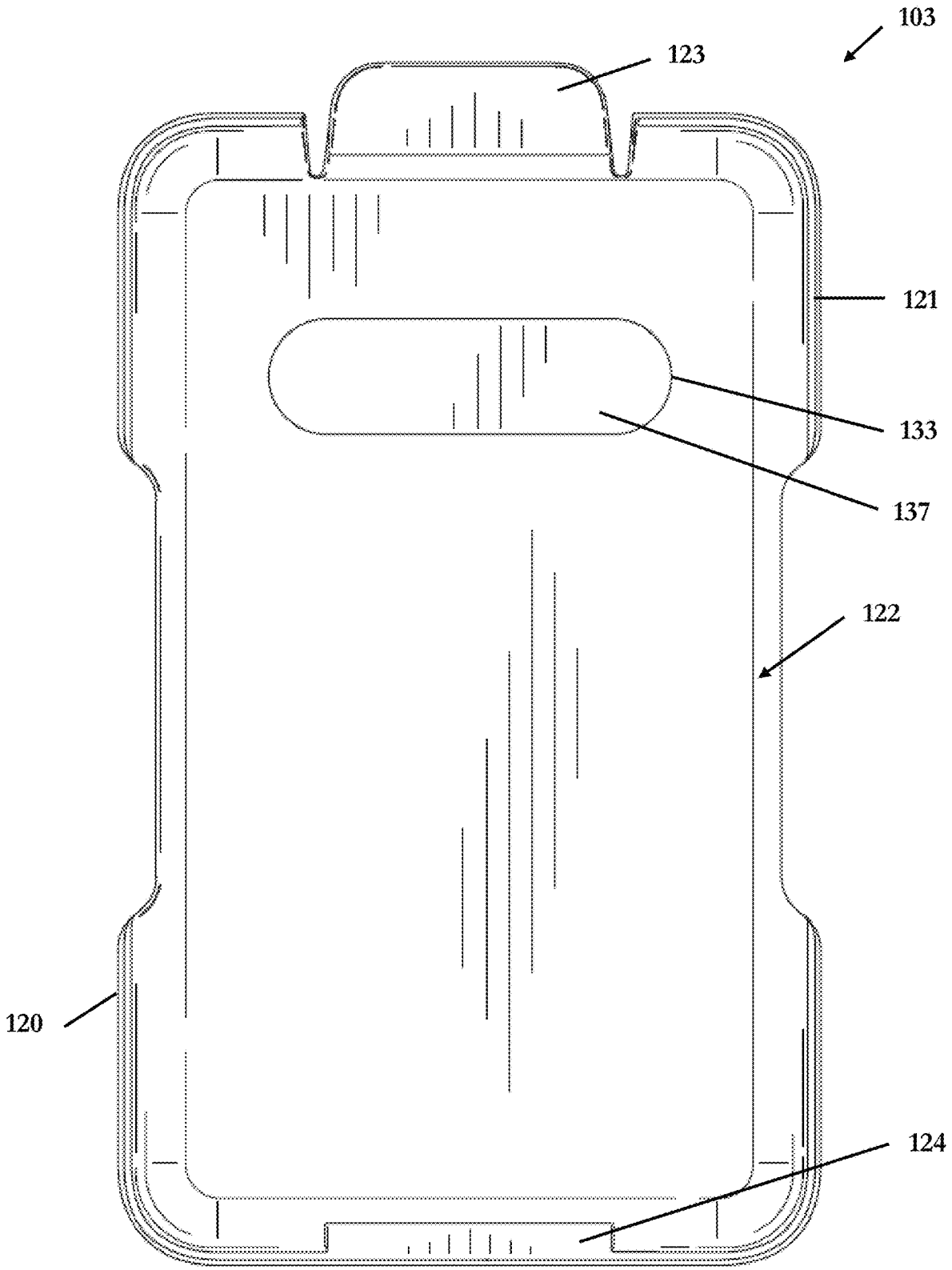
FIG. 28 is a front view of the holder of FIG. 18A.
Figure 29:
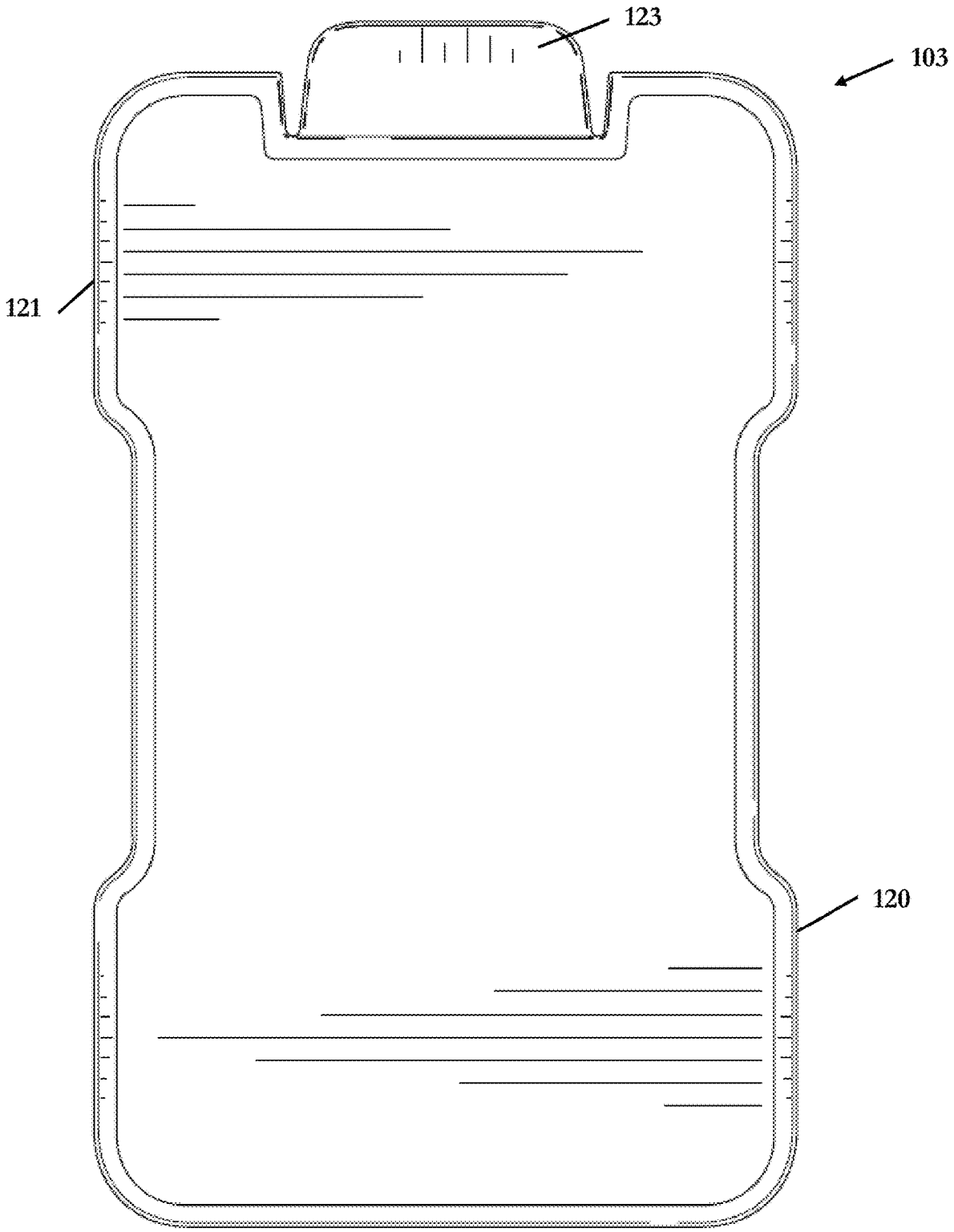
FIG. 29 is a rear view of the holder of FIG. 18A.
Figure 30:
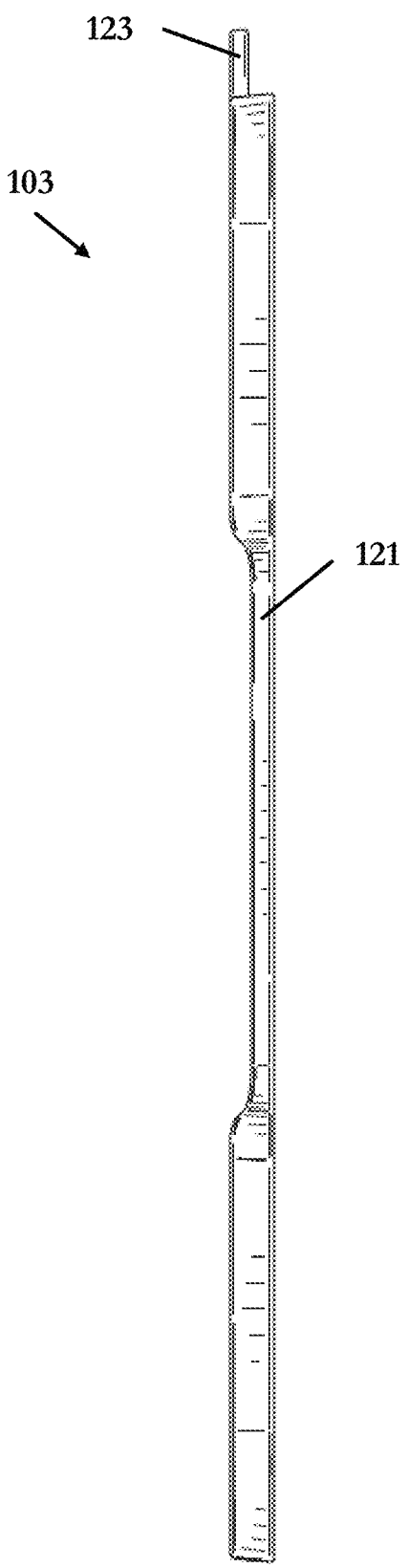
FIG. 30 is a right side view of the holder of FIG. 18A.
Figure 31:
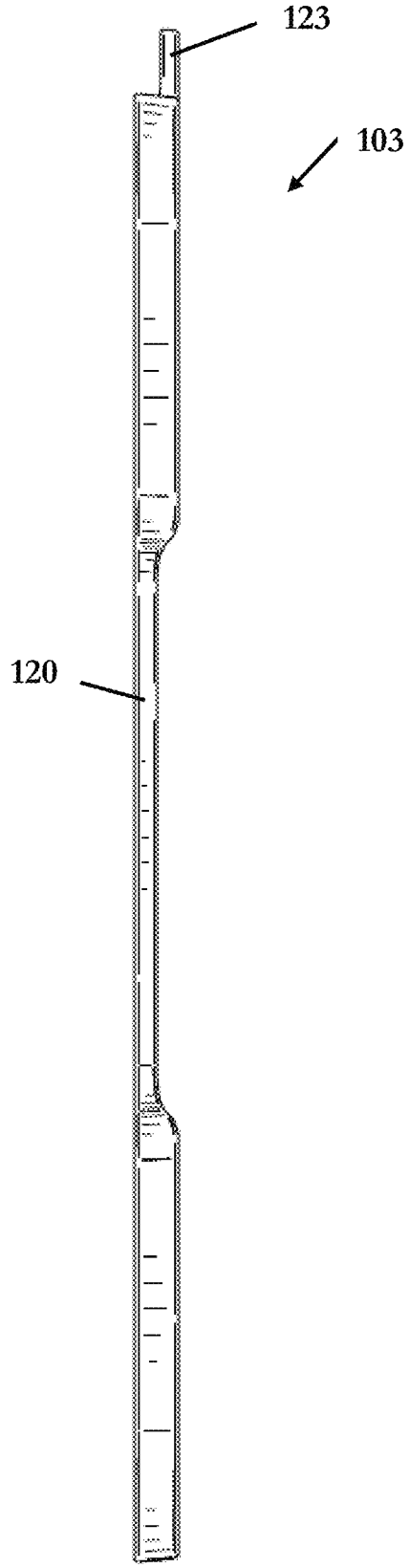
FIG. 31 is a left side view of the holder of FIG. 18A.
Figure 32:
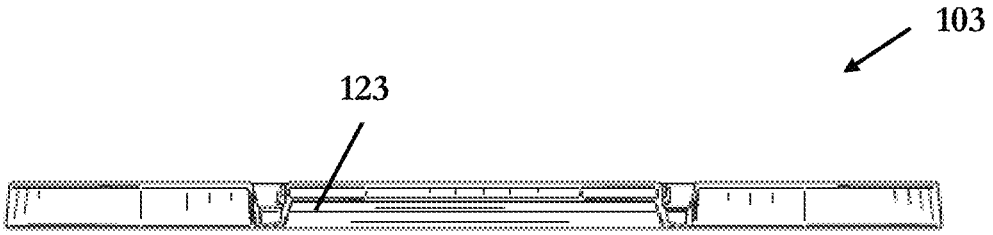
FIG. 32 is a top view of the holder of FIG. 18A.
Figure 33:
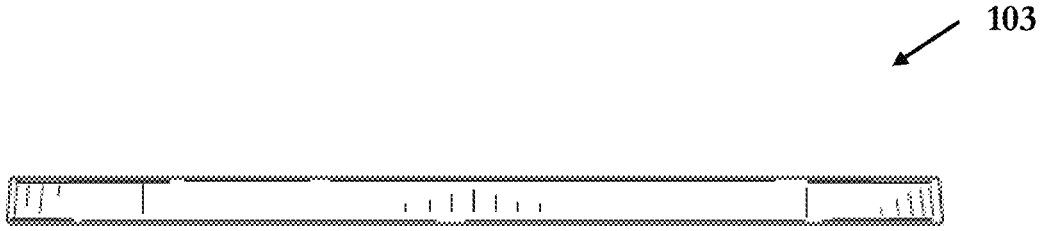
FIG. 33 is a bottom view of the holder of FIG. 18A.

Third, as shown in FIGS. 18B and 18C, a bumper cavity 136 in the wallet housing 104 configured for receiving and maintaining elastomeric bumper 113 arranged around axle 114 does not extend to the exposed surface of the front wallet wall 105 such that the wallet housing 104 excludes the axle opening 27 and is flush in the area of the front wallet wall 105 corresponding to the area of the front wallet wall 5 where the axle opening 27 is located in the wallet housing 4. In this manner, the bumper 113 and the axle 114 is not exposed by the wallet 102 and is not susceptible to being removed through the exposed surface of the front wallet wall 105. Indeed, the axle 114 does not include the cap included on the axle 14 that provides the cover for axle opening 27. The use of the separable upper and lower wallet parts 133, 134 allows the axle 114 to be inserted between the upper and lower wallet parts before assembly of these parts.

Fourth, each of first attachment recess or opening 128, second attachment recess or opening 129, third attachment recess or opening 130, and fourth attachment recess or opening 131 defined by the wallet housing 104 have a greater width in a direction along the respective upper and lower wallet walls 107, 108 than the respective widths of counterpart first attachment recess or opening 28, second attachment recess or opening 29, third attachment recess or opening 30, and fourth attachment recess or opening 31 defined by the wallet housing 4 in a direction along the respective upper and lower wallet walls 7, 8. In this manner, each of first attachment recess or opening 128, second attachment recess or opening 129, third attachment recess or opening 130, and fourth attachment recess or opening 131 are configured to receive wider flexible protrusion 123 and wider rigid protrusion 124 of the holder 103.

The holder 103 is the same as the holder 3 or the variations of the holder 3 with two other specific differences in addition to the wider protrusions 123, 124. The first of these other differences is that the flexible protrusion 123 of the holder 103 has a greater length in a direction parallel to the holder first and second holder side walls 120, 121 than the length of the flexible protrusion 23 of the holder 3 in a direction parallel to the holder first and second holder side walls 20, 21. As such, the flexible protrusion 123 has sufficient surface area such that a user may press the flexible protrusion like a button to release the wallet 102 when the wallet is assembled to the holder 103, i.e., when the flexible protrusion 123 is received in any one of the first attachment recess or opening 128, second attachment recess or opening 129, third attachment recess or opening 130, and fourth attachment recess or opening 131 and the rigid protrusion 124 is received in the opposing first attachment recess or opening 128, second attachment recess or opening 129, third attachment recess or opening 130, and fourth attachment recess or opening 131. In this manner, a greater, and preferably a much greater, amount of pull force may need to be applied to the wallet 102 to separate the wallet 102 from the holder 103 than is required to be applied to the wallet 2 to separate the wallet 2 from the holder 3. In such configurations, a flange portion of protrusions 123, 124 to be received in each of first attachment recess or opening 128, second attachment recess or opening 129, third attachment recess or opening 130, and fourth attachment recess or opening 131 and such recesses or openings themselves preferably may be configured such that at least a 0.8 mm depth (in a direction towards a middle of the holder 103) of the flange portion of the protrusions is received in opposing ones of the recesses or openings when the wallet 102 is connected with the holder 103.

The second of the other differences is that the holder pocket 122 of the holder 103 includes a shallow recess 135 that extends inwardly from the holder front side 116 and a holder bumper 137 that may be received in the shallow recess. Examples of suitable materials for the holder bumper 137 include thermoplastic elastomers ("TPEs"), thermoplastic polyurethane ("TPU"), polyolefins, silicone, rubber, and any combination thereof. Upon the placement of the wallet 102 against the holder 103, the wallet 102 compresses the holder bumper 137 such that the holder bumper reacts to push the respective first attachment recess or opening 128, second attachment recess or opening 129, third attachment recess or opening 130, and fourth attachment recess or opening 131 against flange portions of the protrusions 123, 124 received in such recesses or openings. In particular, the holder bumper 137 pushes the wallet 102 such that the flange portions of the protrusions 123, 124 are maintained against the side of the respective first attachment recess or opening 128, second attachment recess or opening 129, third attachment recess or opening 130, and fourth attachment recess or opening 131 into which the protrusions are received that is closest to the holder 103. In this manner, play between the flange portions of the protrusions and the respective first attachment recess or opening 128, second attachment recess or opening 129, third attachment recess or opening 130, and fourth attachment recess or opening 131 into which the protrusions are received is reduced or eliminated, thereby dampening noise or other vibration due to contact between the wallet 102 and the holder 103.

Figure 34A:
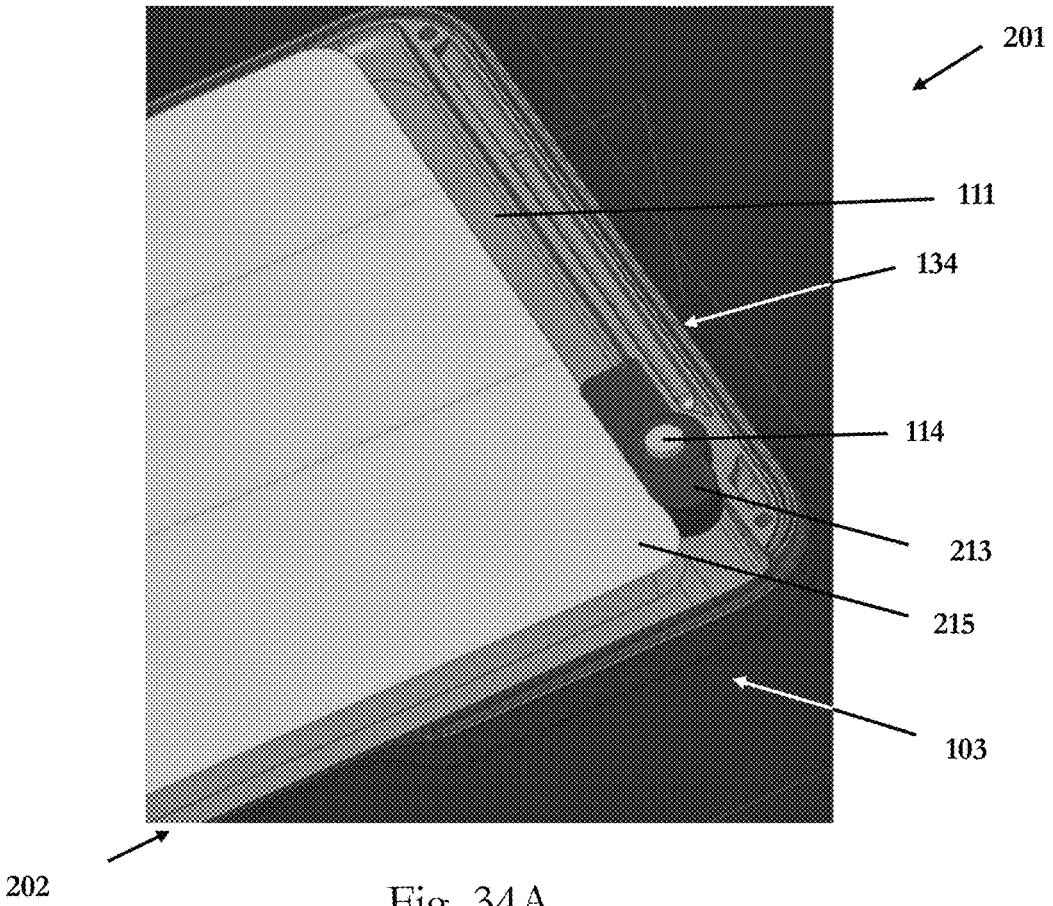
FIG. 34A is a perspective cross-sectional view of a wallet kit in accordance with another embodiment of the invention, shown with a set of cards inserted into the wallet kit.
Figure 34B:
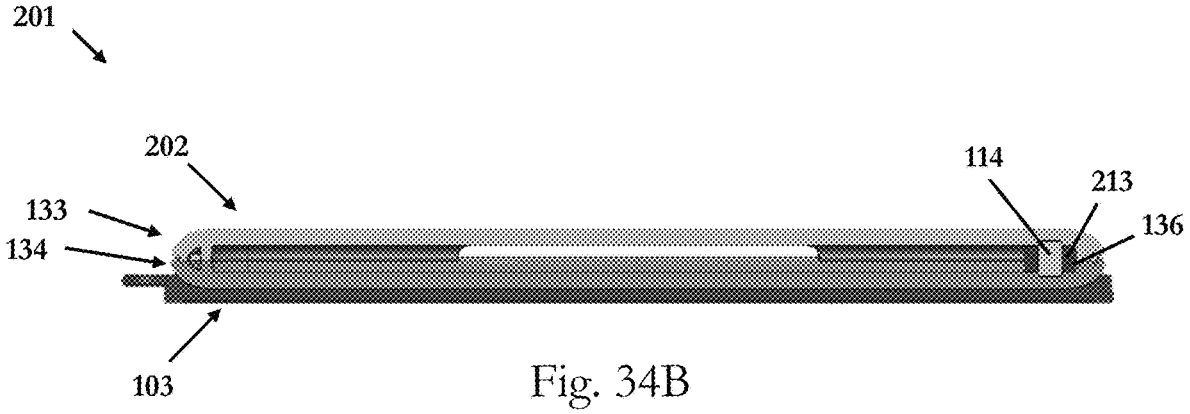
FIG. 34B is a left side cross-sectional view of the wallet kit of FIG. 34A.

Referring now to FIGS. 34A and 34B, a wallet kit 201 is the same as the wallet kit 101 with the exception that the wallet kit 201 includes an elastomeric bumper 213, in place of the bumper 113, arranged around the axle 114. In this example, the elastomeric bumper 213 and the axle 114 are placed between the upper and lower wallet parts 133, 134 in the same manner that the elastomeric bumper 113 and the axle 114 are placed between the upper and lower wallet parts. As shown in FIG. 34A, the elastomeric bumper 213 acts as a wedge such that upon insertion of one or more cards 215 into the pocket 111 of the wallet 202, the bumper 213 presses the card or cards 215 against an upper wallet wall defined by the upper and lower wallet parts 133, 134 in the same manner that the bumpers 13, 113 press a card or cards inserted into the respective wallets 2, 102. The elastomeric bumper 213 extends a greater distance into the pocket 111 than the bumpers 13, 113 to provide a greater surface area for contacting the card or cards 215 and thus exerts a greater force against the cards to hold the cards in place in the wallet 202 when the axle 114 is placed in the corresponding bumper cavity 136 defined by the upper and lower wallet parts 133, 134.

It is noted that the terminology used above is for the purpose of reference only, and is not intended to be limiting. For example, terms such as "upper", "lower", "above", "below", "rightward", "leftward", "clockwise", and "counterclockwise" refer to directions in the drawings to which reference is made. As another example, terms such as "inward" and "outward" may refer to directions toward and away from, respectively, the geometric center of the component described. As a further example, terms such as "front", "rear", "side", "left side", "right side", "top", "bottom", "horizontal", and "vertical" describe the orientation of portions of the component within a consistent but arbitrary frame of reference which is made clear by reference to the text and the associated drawings describing the component under discussion. Such terminology will include the words specifically mentioned above, derivatives thereof, and words of similar import.

While this invention has been described in conjunction with the specific embodiments outlined above, it is evident that many alternatives, modifications, and variations will be apparent to those skilled in the art. Indeed, the disclosure set forth herein includes all possible combinations of the particular features set forth above, whether specifically disclosed herein or not. For example, where a particular feature is disclosed in the context of a particular aspect, arrangement, configuration, or embodiment, that feature can also be used, to the extent possible, in combination with and/or in the context of other particular aspects, arrangements, configurations, and embodiments of the invention, and in the invention generally. Moreover, the disclosure set forth herein includes the mirror image, i.e., mirror configuration, taken from any perspective of any drawing or other configuration shown or described herein. Accordingly, the preferred embodiments of the invention as set forth above are intended to be illustrative, not limiting. Various changes may be made without departing from the spirit and scope of the inventions as defined in the following claims.

In addition, it is noted that citation or identification of any document in this application is not an admission that such document is available as prior art to the present invention.

REFERENCE NUMBERS

1, 101, 201 wallet kit
2, 102, 202 wallet
3, 103 holder
4, 104 wallet housing
5, 105 front wallet wall
6, 106 rear wallet wall
7, 107 upper wallet wall
8, 108 lower wallet wall
9 first wallet side wall
10 second wallet side wall
11, 111 wallet pocket
12, 112 first wallet opening
13, 113, 213 elastomeric bumper
14, 114 axle
15 second wallet opening
16 holder front side
17 holder rear side
18 upper holder wall
19 lower holder wall
20, 120 first holder side wall
21, 121 second holder side wall
22, 122 holder pocket
23, 123 flexible protrusion
24, 124 rigid protrusion
25 first holder opening
26 second holder opening
17 axle opening
28, 128 first attachment recess or opening
29, 129 second attachment recess or opening
30, 130 third attachment recess or opening
31, 131 fourth attachment recess or opening
32 rear holder wall
133, 233 upper wallet part
134, 234 lower wallet part
135 shallow recess
136 bumper cavity
137 holder bumper
215 card or cards

The invention claimed is:

1. A wallet kit configured for attachment to a mobile electronic device or a mobile electronic device case configured for removably receiving the mobile electronic device, the wallet kit comprising:

a wallet comprising:

a housing that has:

a front wallet wall;

a rear wallet wall opposite to the front wallet wall;

an upper wallet wall that connects an upper end of the rear wallet wall to an upper end of the front wallet wall;

a lower wallet wall that is opposite to the upper wallet wall and which connects a lower end of the rear wallet wall to a lower end of the front wallet wall;

a first wallet side wall that is between the upper wallet wall and the lower wallet wall and which connects a first side end of the rear wallet wall to a first side end of the front wallet wall;

a second wallet side wall that is between the upper wallet wall and the lower wallet wall and which connects a second side end of the rear wallet wall to a second side end of the front wallet wall;

a wallet pocket that is formed by the front wallet wall, the rear wallet wall, the upper wallet wall, the lower wallet wall, and the second wallet side wall, the wallet pocket being configured to hold a card; and a first wallet opening that is formed in the first wallet side wall, and which is configured to accept insertion of the card into the wallet pocket;

an axle; and an elastomeric bumper arranged around the axle and inside the wallet pocket, wherein the front wallet wall is configured to face away from the one of the mobile electronic device or the mobile electronic device case when the wallet kit is attached to the one of the mobile electronic device or the mobile electronic device case, and wherein the front wallet wall covers the axle and the elastomeric bumper such that the axle and the elastomeric bumper are not exposed when the front wallet wall is arranged facing away from the one of the mobile electronic device or the mobile electronic device case.

2. The wallet kit according to claim 1, wherein the housing further has a second wallet opening formed in the front wall which allows access to a card when arranged in the wallet pocket, the second opening being different from the first wallet opening.

3. The wallet kit according to claim 2, wherein the first wallet opening is also formed in the front wallet wall so that the front wallet wall has a shape in the form of an hourglass as a result of the first and the second wallet openings.

4. The wallet kit according to claim 1, wherein the housing comprises at least one material selected from the group consisting of hardened plastic materials, rigid or semi-rigid plastic materials, rigid rubber materials, polycarbonate materials, para-aramid materials, wood, and combinations thereof.

5. The wallet kit according to claim 1, further comprising:

a holder having:

a front side configured to removably attach to the wallet; and a rear side opposite to the front side configured to attach to a rear of the mobile electronic device or the mobile electronic device case.

6. The wallet kit according to claim 5, wherein the holder further has a holder pocket configured to accept the wallet.

7. The wallet kit according to claim 5, wherein the holder further includes an attachment mechanism configured to securely attach the wallet to the holder.

8. The wallet kit according to claim 7, wherein the housing of the wallet has a first attachment recess or opening, and wherein the attachment mechanism comprises:

a first protrusion configured to fit into and be accepted by the first attachment recess or opening when the wallet is arranged in the holder pocket with the rear wallet wall located between the holder and the front wallet wall.

9. The wallet kit according to claim 8, wherein the housing of the wallet has a second attachment recess or opening, and wherein the attachment mechanism further comprises:

a second protrusion configured to fit into and be accepted by the second attachment recess or opening when the wallet is arranged in the holder pocket with the rear wallet wall located between the holder and the front wallet wall.

10. The wallet kit according to claim 7, wherein the housing of the wallet has an attachment recess or opening, and wherein the attachment mechanism comprises:

a first protrusion configured to fit into and be accepted by the attachment recess or opening when the wallet is arranged in the holder pocket with the front wallet wall located between the holder and the rear wallet wall.

11. The wallet kit according to claim 10, wherein the housing of the wallet has a further attachment recess or opening, and wherein the attachment mechanism further comprises:

a second protrusion configured to fit into and be accepted by the further attachment recess or opening when the wallet is arranged in the holder pocket with the front wallet wall located between the holder and the rear wallet wall.

12. The wallet kit according to claim 8, wherein the holder further has:

a rear holder wall;

an upper holder wall that extends from an upper end of the rear holder wall;

a lower holder wall that is opposite to the upper holder wall, and which extends from a lower end of the rear holder wall;

a first holder side wall that is between the upper holder wall and the lower holder wall, and which extends from the rear holder wall; and a second holder side wall that is between the upper holder wall and the lower holder wall, and which extends from the rear holder wall; and wherein the holder pocket is formed by the rear holder wall, the upper holder wall, the lower holder wall, the first holder side wall, and the second holder side wall.

13. The wallet kit according to claim 12, wherein the first protrusion extends from the upper end of the rear holder wall, the first protrusion being separate from the upper holder wall and arranged between a first part of the upper holder wall and a second part of the upper holder wall.

14. The wallet kit according to claim 12, wherein the first protrusion extends from the lower holder wall, the first protrusion being part of the lower holder wall.

15. The wallet kit according to claim 12, wherein the housing further has a second wallet opening formed in the front wall which allows access to a card when arranged in the wallet pocket, the second opening being different from the first wallet opening, and wherein a first holder opening is formed in the first holder side wall, the first holder opening corresponding to and aligning with the first wallet opening or the second wallet opening when the wallet is arranged in the holder pocket.

16. The wallet kit according to claim 15, wherein a second holder opening is formed in the second holder side wall, the second holder opening corresponding to and aligning with the other of the first wallet opening or the second wallet opening when the wallet is arranged in the holder pocket.

17. A wallet kit configured for attachment to a mobile electronic device case configured for removably receiving the mobile electronic device, the wallet kit comprising:

a wallet comprising:

a housing having:

a front wallet wall;

a rear wallet wall opposite to the front wallet wall;

an upper wallet wall that connects an upper end of the rear wallet wall to an upper end of the front wallet wall;

a lower wallet wall that is opposite to the upper wallet wall, and which connects a lower end of the rear wallet wall to a lower end of the front wallet wall;

a first wallet side wall that is between the upper wallet wall and the lower wallet wall, and which connects a first side end of the rear wallet wall to a first side end of the front wallet wall;

a second wallet side wall that is between the upper wallet wall and the lower wallet wall, and which connects a second side end of the rear wallet wall to a second side end of the front wallet wall;

a wallet pocket that is formed by the front wallet wall, the rear wallet wall, the upper wallet wall, the lower wallet wall, and the second wallet side wall, the wallet pocket being configured to hold a card; and a first wallet opening that is formed in the first wallet side wall, and which is configured to accept insertion of the card into the wallet pocket; and a holder attachable to the mobile electronic device case having:

a front side configured to removably attach to the wallet; and a rear side opposite to the front side configured to attach to a rear of the mobile electronic device case, wherein the front wallet wall or the rear wallet wall are configured to face away from the mobile electronic device case when the wallet kit is attached to the mobile electronic device case.

18. The wallet kit according to claim 17, wherein the housing of the wallet has a first attachment recess or opening, and wherein the holder further has an attachment mechanism configured to securely attach the wallet to the holder, the attachment mechanism comprising:

a first protrusion configured to fit into and be accepted by the first attachment recess or opening when the wallet is arranged in a holder pocket defined by the holder with the rear wallet wall located between the holder and the front wallet wall.

19. The wallet kit according to claim 18, wherein the holder further has:

a rear holder wall;

an upper holder wall that extends from an upper end of the rear holder wall;

a lower holder wall that is opposite to the upper holder wall, and which extends from a lower end of the rear holder wall;

a first holder side wall that is between the upper holder wall and the lower holder wall, and which extends from the rear holder wall; and a second holder side wall that is between the upper holder wall and the lower holder wall, and which extends from the rear holder wall; and wherein the holder pocket is formed by the rear holder wall, the upper holder wall, the lower holder wall, the first holder side wall, and the second holder side wall.

20. The wallet kit according to claim 17, wherein the holder includes an adhesive, the holder being attachable to the mobile electronic device case via the adhesive.

21. A wallet kit configured for attachment to a mobile electronic device or a mobile electronic device case configured for removably receiving the mobile electronic device, the wallet kit comprising:

a wallet comprising:

a housing that has:

a front wallet wall;

a rear wallet wall opposite to the front wallet wall;

an upper wallet wall that connects an upper end of the rear wallet wall to an upper end of the front wallet wall;

a lower wallet wall that is opposite to the upper wallet wall and which connects a lower end of the rear wallet wall to a lower end of the front wallet wall;

a first wallet side wall that is between the upper wallet wall and the lower wallet wall and which connects a first side end of the rear wallet wall to a first side end of the front wallet wall;

a second wallet side wall that is between the upper wallet wall and the lower wallet wall and which connects a second side end of the rear wallet wall to a second side end of the front wallet wall;

a wallet pocket that is formed by the front wallet wall, the rear wallet wall, the upper wallet wall, the lower wallet wall, and the second wallet side wall, the wallet pocket being configured to hold a card;

a first wallet opening that is formed in the first wallet side wall, and which is configured to accept insertion of the card into the wallet pocket; and an axle opening;

an axle; and an elastomeric bumper arranged inside the wallet pocket, wherein the front wallet wall or the rear wallet wall are configured to face away from the one of the mobile electronic device or the mobile electronic device case when the wallet kit is attached to the one of the mobile electronic device or the mobile electronic device case, and wherein the axle opening is configured to accept insertion of the axle with the elastomeric bumper there-around into the wallet pocket.

* * * * *